US006407654B1

(12) United States Patent
Saito et al.

(10) Patent No.: US 6,407,654 B1
(45) **Date of Patent: *Jun. 18, 2002**

(54) ELECTROMAGNETIC RELAY, APPARATUS AND METHOD FOR MAKING IT

(75) Inventors: Masao Saito; Naohiro Tanioka; Yoshiyuki Hosaka, all of Tokyo; Masaaki Sato; Kazuyuki Oyama, both of Ichinoseki, all of (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/558,952

(22) Filed: Apr. 26, 2000

(30) Foreign Application Priority Data

Apr. 27, 1999 (JP) ..... 11-120717

(51) Int. Cl.[7] ..... H01H 51/22
(52) U.S. Cl. ..... 335/80; 335/83
(58) Field of Search ..... 335/78–86, 124, 335/128

(56) References Cited

U.S. PATENT DOCUMENTS 4,703,293 A * 10/1987 Ono et al. ..... 335/80
5,337,029 A * 8/1994 Nobutoki et al. ..... 335/78

FOREIGN PATENT DOCUMENTS

DE 196 35 277 2/1998
EP 0 727 803 8/1996
JP 5-174690 7/1993
JP 5-234485 9/1993
JP 6-196063 7/1994

* cited by examiner

*Primary Examiner*—Lincoln Donovan
(74) *Attorney, Agent, or Firm*—Katten Muchin Zanis Rosenman

(57) ABSTRACT

An electromagnetic relay is basically constructed by an insulation base and an armature block. Herein, the insulation base is constructed by a fixed-side terminal set including fixed contacts, a coil block in which a coil is wound about a middle portion of a U-shape iron core, and a permanent magnet, all of which are integrally held together by a fixed-side insulator. The armature block is constructed by a moving-side terminal set including moving contacts and an armature, all of which are integrally held by a moving-side insulator. The armature block is mounted on the insulation base in such a way that the moving contacts are placed opposite to the fixed contacts respectively, and it is supported by a support point to pivotally move on the permanent magnet under an effect of electromagnetic force. Specifically, the fixed-side insulator is made by molding using resin material to integrally hold the fixed-side terminal set, coil block and permanent magnet together at prescribed positions, so it is possible to improve an accuracy in positioning of them. In addition, the fixed-side insulator is formed in a prescribed shape having a contact fixing portion that partly extends to provide engagement portions by which the permanent magnet and U-shape iron core are tightly fixed together under a contact condition where the permanent magnet is placed in tight contact with the side-end portions of the U-shape iron core.

10 Claims, 19 Drawing Sheets

ELECTROMAGNETIC RELAY, APPARATUS AND METHOD FOR MAKING IT

BACKGROUND OF THE INVENTION

1. Field of the Invention

This invention relates to electromagnetic relays in which armature blocks are operated to pivotally move on insulation bases by electromagnetic force so that contacts are being switched over. In addition, this invention also relates to apparatuses and methods for manufacturing the electromagnetic relays.

This application is based on Patent Application No. Hei 11-120717 filed in Japan, the content of which is incorporated herein by reference.

2. Description of the Related Art

Normally, electromagnetic relays that operate to switch over contacts are constructed by insulation bases and armature blocks, for example. Herein, the armature blocks are supported by the insulation bases in such a way that they are capable of moving in a pivotal manner under effects of electromagnetic fields. Specifically, the insulation base of the electromagnetic relay has a fixed-side terminal set including fixed contacts, a sectionally U-shaped iron core (hereinafter, simply referred to as a "U-shape iron core" having a cross section which is basically formed in rectangular shape, one side portion of which is opened), and a permanent magnet, all of which are integrally held by a fixed-side insulator. Herein, a coil is wound about a middle portion of the U-shape iron core, and the permanent magnet is inserted and engaged between side-end portions on both ends of the U-shape iron core. In addition, the armature block of the electromagnetic relay has moving-terminal members including moving contacts, and armatures which can be arranged opposite to each other at the side-end portions of the U-shape iron core, all of which are integrally held by a moving-side insulator. Thus, the armature block is supported in such a way that it is able to pivotally move towards the permanent magnet of the insulation base.

Conventionally, the electromagnetic relays of the aforementioned type are designed to have insulation bases, which are manufactured as follows:

A permanent magnet is inserted and engaged between side-end portions on both ends of the U-shape iron core in which a coil is wound about a middle portion. The side-end portions and permanent magnet are fixed together in advance by welding or bonding which is effected using adhesive, so that a joint unit is being made. Such a joint unit is arranged in a metal mold together with the fixed-side terminal set. By the metal mold, the fixed-side terminal set is integrally formed with the joint unit of the U-shape iron core and permanent magnet.

The aforementioned manufacturing technique is disclosed by Japanese Unexamined Patent Publication No. Hei 6-196063, for example.

Since the conventional electromagnetic relays are manufactured such that the permanent magnets are fixedly attached to the side-end portions of the U-shape iron cores by welding or bonding using the adhesive, they suffer from problems, as follows:

(1) When the permanent magnet is fixedly adhered between the side-end portions of the U-shape iron core by welding, sputters in welding are frequently adhered to contact surface portions between the armatures and side-end portions of the U-shape iron core. This causes defectiveness in contacts between the side-end portions and armatures. As a result, magnetic resistance between the U-shape iron core and armatures is remarkably increased. This brings reduction in yield of products being manufactured.

(2) At integral molding of the joint unit which is made by welding by which the permanent magnet is fixedly adhered between the side-end portions of the U-shape iron core, molding burrs are produced from weld portions due to dispersion in amounts of melted matters in welding. When the molding burrs reach the contact surface portions between the armatures and side-end portions of the U-shape iron core, reduction occurs in yield of products being manufactured.

(3) When the permanent magnet is fixedly adhered between the side-end portions of the U-shape iron core by bonding using the adhesive, it is necessary to provide a wait time for waiting for hardening of the adhesive. This brings reduction in productivity of joint units each of which has a U-shape iron core and a permanent magnet being adhered to each other.

(4) The conventional technique requires two steps, i.e., a first step for manufacturing a joint unit having a U-shape iron core and a permanent magnet, and a second step for fixing the joint unit and fixed-side terminal set to the fixed-side insulator by its integral molding. So, it cannot be said that productivity is sufficiently high.

(5) The conventional technique firstly joints a U-shape iron core and a permanent magnet together to form a joint unit. Thereafter, the joint unit and fixed-side terminal set are fixed to the fixed-side insulator by its integral molding. Hence, first error is caused to occur at joint of the U-shape iron core and permanent magnet, and second error is caused to occur at integral molding of the fixed-side insulator. Those errors are accumulated to badly influence positional accuracy in fixing the fixed-side terminal set and the U-shape iron core or permanent magnet in prescribed positions. That is, if positioning of the joint unit is made based on a fixed position of the U-shape iron core in the metal mold, a positional accuracy is deteriorated with respect to the fixed-side terminal set against the permanent magnet. If positioning of the joint unit is made based on the fixed position of the permanent magnet in the metal mold, a positional accuracy is deteriorated with respect to the fixed-side terminal set against the U-shape iron core. In both cases, reductions are caused to occur in electric characteristics of the electromagnetic relays being manufactured.

SUMMARY OF THE INVENTION

It is an object of the invention to provide improvements in a mechanical construction of an electromagnetic relay in which magnetic resistance between a U-shape iron core and armatures is reduced and in which positional accuracy in positioning of fixed-side terminal set with a U-shape iron core and a permanent magnet is improved.

It is another object of the invention to provide an apparatus and method for manufacturing electromagnetic relays with a good yield and good productivity, in which manufacturing steps are simplified by eliminating an unwanted wait time for waiting for hardening of adhesive used for bonding effected between side-end portions of the U-shape iron core and permanent magnet.

An electromagnetic relay of this invention is basically constructed by an insulation base and an armature block. Herein, the insulation base is constructed by a fixed-side terminal set including fixed contacts, a coil block in which a coil is wound about a middle portion of a U-shape iron core, and a permanent magnet, all of which are integrally held together by a fixed-side insulator. The armature block is constructed by a moving-side terminal set including moving contacts, and an armature, all of which are integrally held by a moving-side insulator. The armature block is mounted on the insulation base in such a way that the moving contacts are placed opposite to the fixed contacts respectively, and the armature block is supported by a support point to pivotally move on the permanent magnet under an effect of electromagnetic force. Specifically, the fixed-side insulator is made by molding using resin material to integrally hold the fixed-side terminal set, coil block and permanent magnet together at prescribed positions, so it is possible to improve an accuracy in positioning of the aformentioned parts of the insulation base. In addition, the fixed-side insulator is formed in a prescribed shape having a contact fixing portion that partly extends to provide engagement portions by which the permanent magnet and U-shape iron core are tightly fixed together under a contact condition where the permanent magnet is placed in tight contact with the side-end portions of the U-shape iron core. That is, the contact condition is established by pressing exterior walls of the side-end portions of the U-shape iron core to be in tight contact with terminal surfaces of the permanent magnet, then, integral molding is effected to integrally form the fixed-side insulator having the contact fixing portion whose engagement portions firmly attach the permanent magnet between the side-end portions substantially without forming spaces therebetween. Therefore, it is unnecessary to perform welding on the permanent magnet and U-shape iron core, so it is possible to prevent the side-end portions from being partially melted out due to sputters of welding. This brings good contact with respect to the armature, and it is possible to reduce magnetic resistance between the U-shape iron core and armature. In addition, it is unnecessary to perform adhesion using adhesive between them, so it is possible to simplify manufacture of the electromagnetic relay by eliminating a wait time for waiting for hardening of the adhesive. Thus, it is possible to improve yield and productivity in manufacturing electromagnetic relays.

Incidentally, positioning of the permanent magnet and U-shape iron core is actualized in a variety of ways in a metal mold. For example, the engagement portions are formed in hook shapes that engage with channels formed on an upper surface of the permanent magnet to face with the armature block. Or, they are formed in cylindrical shapes that engage with positioning holes formed to penetrate through the permanent magnet. Or, they are formed in elongated block shapes that engage with cut sections being formed on elongated sides of the permanent magnet. Or, they are formed in shapes that interconnect with positioning projections formed on the upper surface of the permanent magnet.

In addition, the metal mold is constructed using an upper mold and side molds. The side molds are moved to approach each other in a clamping mode to press the exterior walls of the side-end portions of the U-shape iron core to be in tight constant with terminal surfaces of the permanent magnet. In addition, an engagement channel is formed in the upper mold to engage with the permanent magnet and is formed to cope with a variety of shapes of the permanent magnet. For example, mold projections are formed in the engagement channel of the upper mold to partially engage with the channels of the permanent magnet.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

Firstly, descriptions will be given with respect to a mechanical construction of an electromagnetic relay, which is placed on a horizontal plane.

Figure 1A:
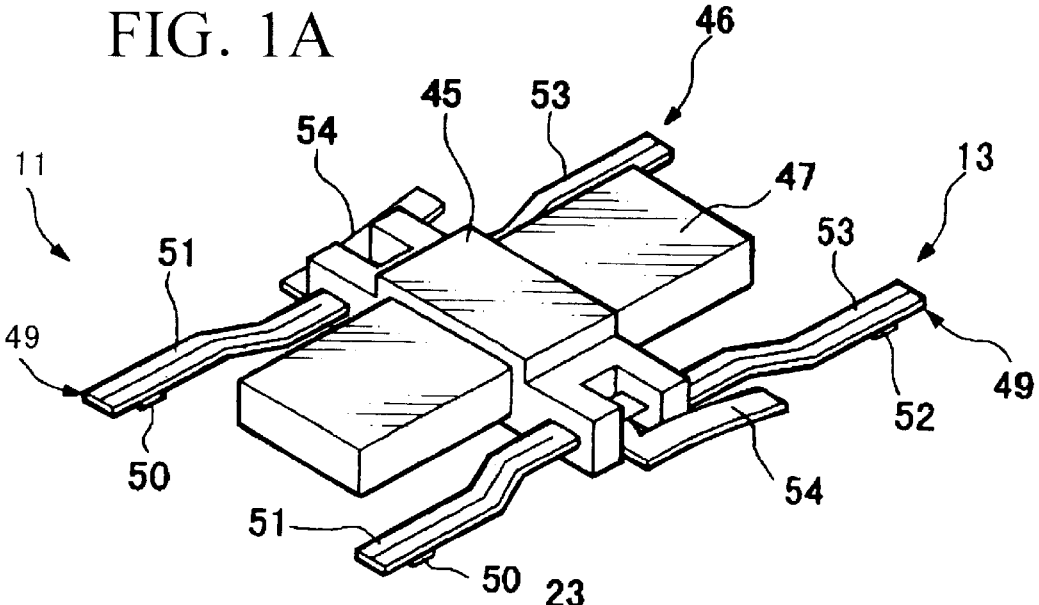
FIG. 1A is an exploded perspective view showing a construction of an armature block, which is a part of an electromagnetic relay being constructed in accordance with preferred embodiment of the invention.
Figure 1B:
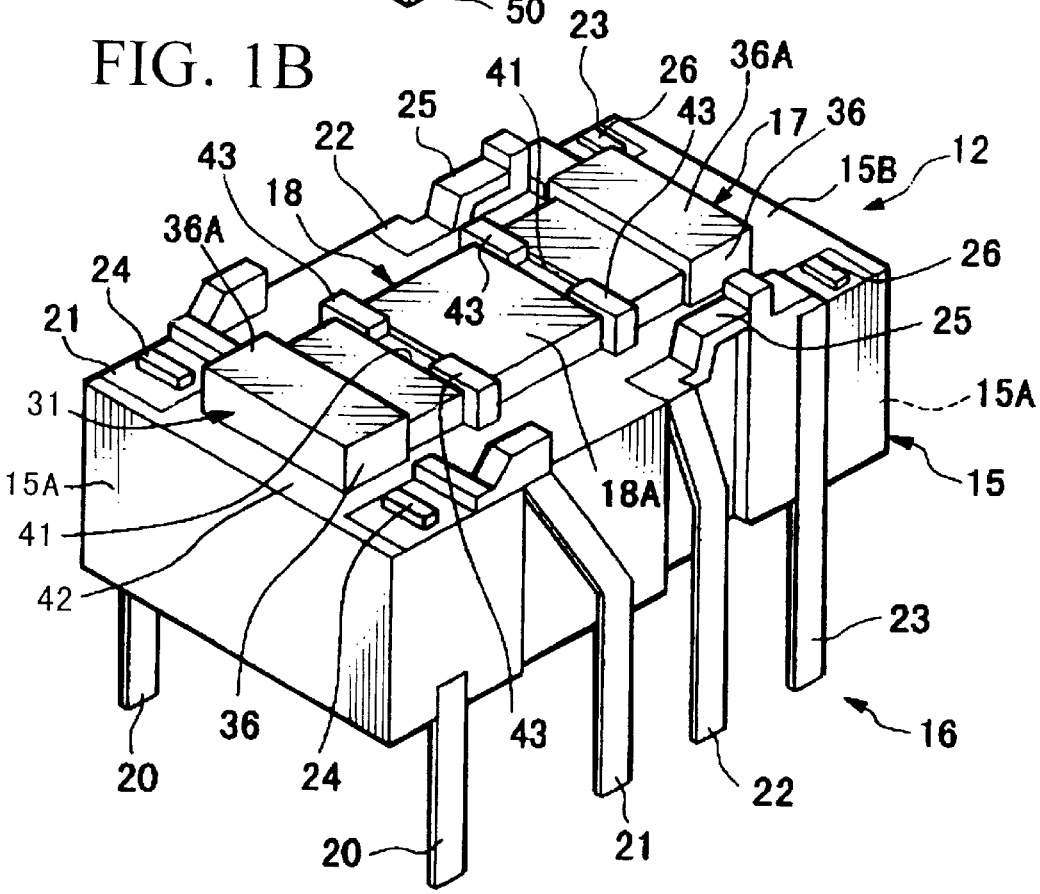
FIG. 1B is an exploded perspective view showing a construction of an insulation base, which is another part of the electromagnetic relay.
Figure 2:
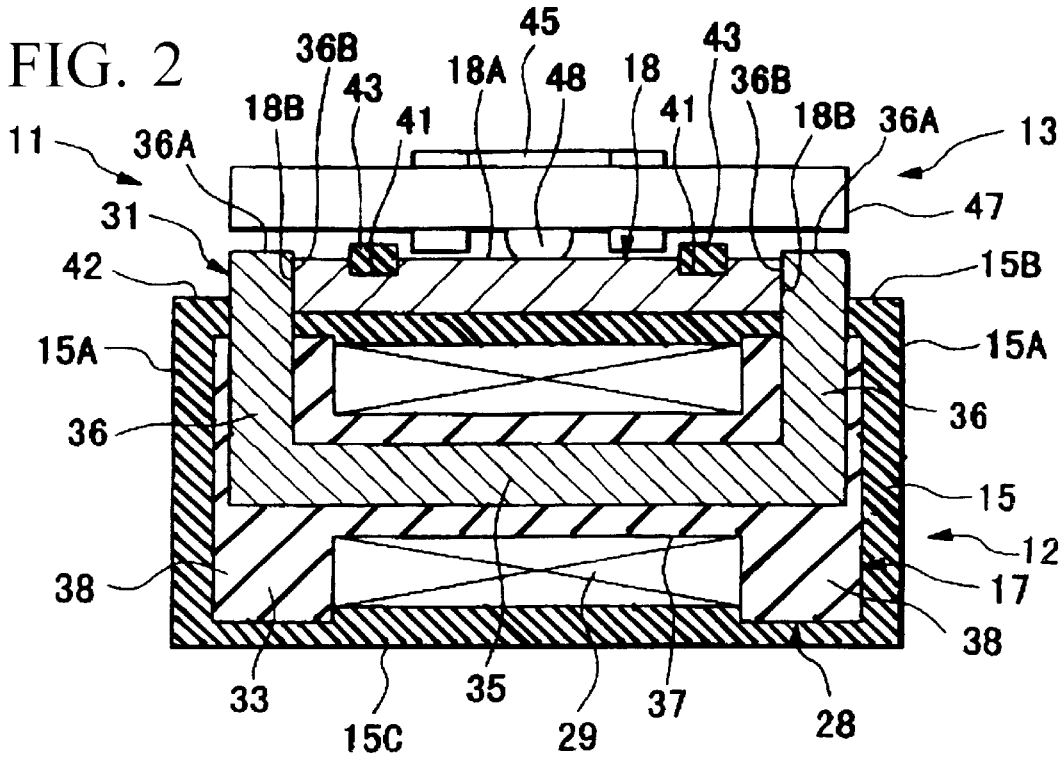
FIG. 2 is a traverse sectional view showing an internal construction of the electromagnetic relay.

As shown in FIGS. 1A, 1B and FIG. 2, an electromagnetic relay 11 has an insulation base 12 and armature blocks 13, which are covered with an insulating cover (not shown).

1. Insulation Base

The insulation base 12 is constructed by a fixed-side insulator 15 roughly having a rectangular parallelepiped shape which is elongated in a lateral direction, a fixed-side terminal set 16, a coil block 17 and a permanent magnet 18. Herein, the fixed-side insulator 15 is made of material which is melted by heating and is integrally formed by injection molding. In addition, the fixed-side terminal set 16, coil block 17 and permanent magnet 18 are integrally held by being partially buried in the fixed-side insulator 15 which is integrally formed as described above.

The fixed-side terminal set 16 is constructed by a pair of coil extension terminals 20, a pair of fixed terminals 21, a pair of mid-terminals 22 and a pair of fixed terminals 23.

The fixed-side insulator 15 has end surfaces 15A, which are arranged opposite to each other in an elongated-side direction of the fixed-side insulator 15. The pair of the coil extension terminals 20 are arranged in proximity to one of the end surfaces 15A of the fixed-side insulator 15. Herein, they are arranged being opposite to each other in a width direction of the fixed-side insulator 15. The coil extension terminals 20 project downwardly from a lower portion of the fixed-side insulator 15.

The pair of the fixed terminals 21 are arranged along elongated sides of the fixed-side insulator 15, wherein they are arranged to be apart from the aforementioned end surface 15A of the fixed-side insulator 15, which is placed in proximity to the coil extension terminals 20. Herein, they are arranged opposite to each other in the width direction of the fixed-side insulator 15. The fixed terminals 21 respectively have fixed contacts 24, which are arranged on an upper surface 15B of the fixed-side insulator 15. Thus, the fixed contacts 24 are contained in the fixed-side terminal set 16. Incidentally, each of the fixed terminals 21 is formed such that one end thereof leaves from the fixed contact 24 and projects downwardly from the upper surface 15B of the fixed-side insulator 15.

The pair of the mid-terminals 22 are arranged along the elongated sides of the fixed-side insulator 15, wherein they are arranged to be apart from the coil extension terminals 20 and fixed terminals 21 sequentially. Herein, they are arranged opposite to each other in the width direction of the fixed-side insulator 15. The mid-terminals 22 respectively have support members 25, which are arranged on the upper surface 15B of the fixed-side insulator 15. Each of the mid-terminals 22 is formed such that one end thereof leaves from the support member 25 and projects downwardly from the upper surface 15B of the fixed-side insulator 15.

The pair of the other fixed terminals 23 are arranged along the elongated sides of the fixed-side insulator 15, wherein they are arranged to be apart from the coil extension terminals 20, fixed terminals 21 and the mid-terminals 22 sequentially. Herein, they are arranged opposite to each other in the width direction of the fixed-side insulator 15. The fixed terminals 23 respectively have fixed contacts 26, which are arranged on the upper surface 15B of the fixed-side insulator 15. Thus, the fixed contacts 26 are contained in the fixed-side terminal set 16. Each of the fixed terminals 23 is formed such that one end thereof leaves from the fixed contact 26 and projects downwardly from the upper surface 15B of the fixed-side insulator 15.

Figure 3:
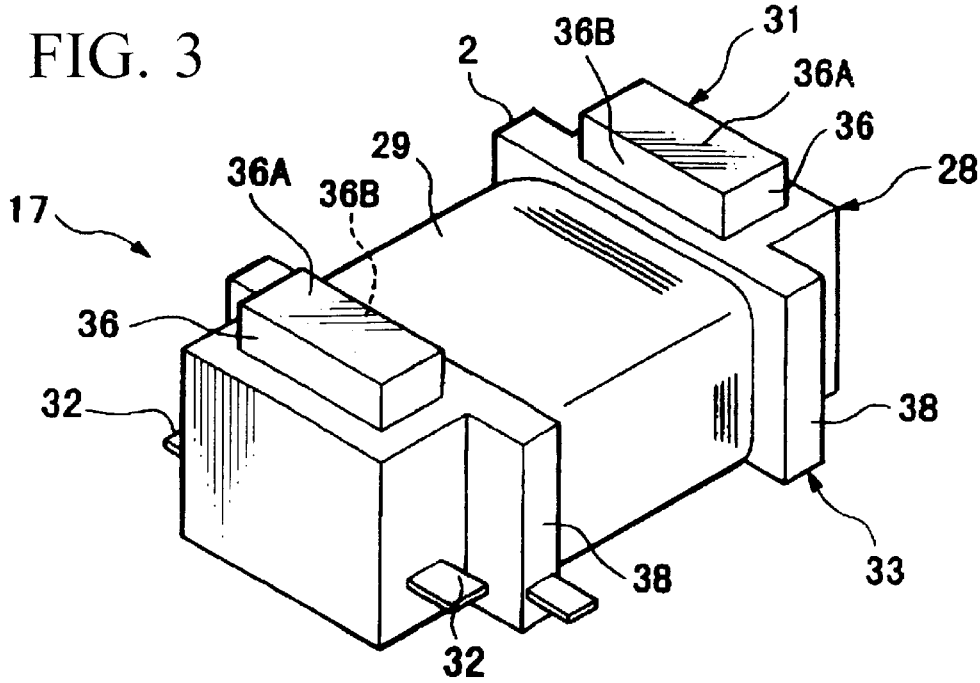
FIG. 3 is a perspective view showing a construction of a coil block contained in the insulation base.

Almost overall portion of the coil block 17 is buried in the fixed-side insulator 15. As shown in FIGS. 2 and 3, the coil block 17 is constructed by a coil spool 28 and a coil 29. Herein, the coil 29 is wound about the coil spool 28.

The coil spool 28 is constructed by a U-shape iron core 31, a pair of coil terminals 32 and an insulator 33.

The U-shape iron core 31 has a middle portion 35 and a pair of side-end portions 36. Herein, the middle portion 35 of the U-shape iron core 31 is formed linearly and arranged horizontally. In addition, the side-end portions 36 project upwardly and vertically from both ends of the middle portion 35 in its elongated-side direction.

The insulator 33 has a cylinder 37 and a pair of flanges 38. Herein, the cylinder 37 is formed to cover an overall area of the middle portion 35 of the U-shape iron core 31. In addition, the flanges 38 are formed to extend from both ends of the cylinder 37 in its outside direction such that they cover base ends of the side-end portions 36.

The pair of the coil terminals 32 are partially buried in one of the flanges 38 of the insulator 33 such that one ends thereof project horizontally from the flange 38 in opposite directions respectively.

The coil spool 28 is formed by integral molding (e.g., injection molding) of the insulator 33 under a condition where the U-shape iron core 31 and the pair of coil terminals 32 are respectively placed in a metal mold (57).

Then, the coil block 17 is formed by winding the coil 29 about the cylinder 37, which is arranged between the flanges 38 of the insulator 33 of the coil spool 28. As a result, the coil 29 is being wound about the middle portion 35 of the U-shape iron core 31 by way of the cylinder 37.

The aforementioned coil block 17 is buried in the fixed-side insulator 15, wherein the side-end portions 36 of the U-shape iron core 31 respectively having terminal surfaces 36A are arranged vertically and exposed from the upper surface 15B of the fixed-side insulator 15. That is, the side-end portions 36 are substantially buried in the fixed-side insulator 15, but their ends having the terminal surfaces 36A project upwardly from the upper surface 15B of the fixed-side insulator 15.

Figure 4:
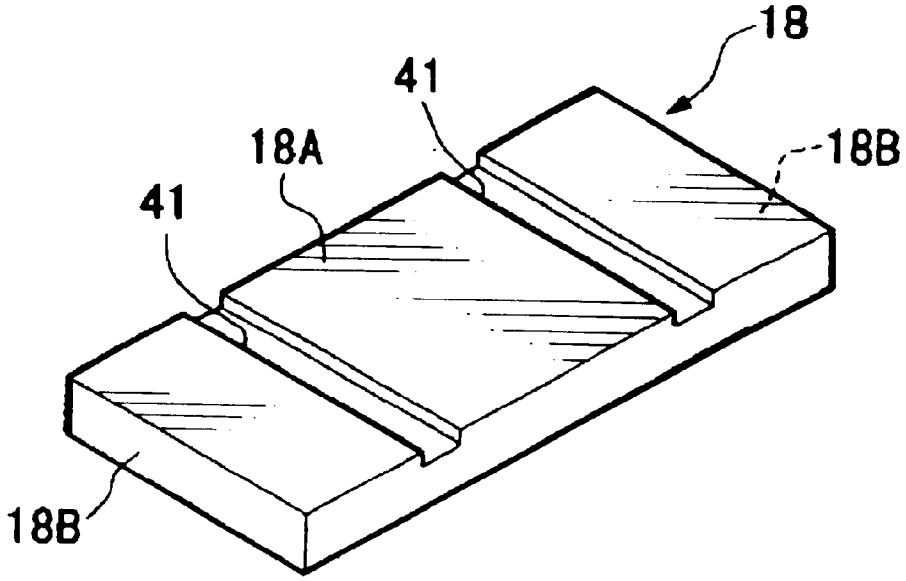
FIG. 4 is a perspective view showing a permanent magnet being mounted on a U-shape iron core of the coil block.

As shown in FIG. 4, the permanent magnet 18 is formed like a flat plate having a rectangular parallelepiped shape. The permanent magnet 18 is being inserted and engaged between the side-end portions 36 of the U-shape iron core 31 of the coil block 17. Herein, the permanent magnet 18 is placed in such a way that elongated sides thereof are arranged in a direction for connecting the side-end portions 36 of the U-shape iron core 31, while elongated sides and short sides thereof are arranged in conformity with sides of the upper surface of the fixed-side insulator 15. In other words, the permanent magnet 18 is mounted on the upper surface 15B of the fixed-side insulator 15 in such a way that a thickness direction thereof (i.e., approximately vertical direction in FIG. 4) is perpendicular to the upper surface 15B.

The armature block 13 is arranged (or mounted) on an upper surface 18A of the permanent magnet 18. A pair of channels 41 are formed at selected locations of the permanent magnet 18, which are arranged being apart from each other in an elongated-side direction of the permanent magnet 18. Herein, each of the channels 41 extends linearly in the width direction of the permanent magnet 18. A section of the permanent magnet 18 which is encompassed by its elongated sides and thickness-direction sides is formed in a rectangular shape.

As described above, the fixed-side terminal set 16, coil block 17 including the fixed-side terminal set 16, and the permanent magnet 18 are fixed to the fixed-side insulator 15 by its integral molding. As shown in FIGS. 1A, 1B and FIG. 2, a contact fixing portion 42 is formed in the fixed-side insulator 15 by its integral molding such that the permanent magnet 18 is fixed to the U-shape iron core 31 under a condition where the permanent magnet 18 is brought into contact with the side-end portions 36 of the U-shape iron core 31.

In order to insert and engage the permanent magnet 18 between the side-end portions 36 of the U-shape iron core 31, a small gap (or gaps) is provided between the inserted permanent magnet 18 and the side-end portions of the U-shape iron core 31 prior to the integral molding of the fixed-side insulator 15. Details of the above will be described later. The contact fixing portion 42 is formed to eliminate such a gap by deforming the U-shape iron core 31, as follows:

First, there is established a pressed condition between the permanent magnet 18 and the side-end portions 36 of the U-shape iron core 31, which are pressed each other. That is, an interior surface 36B of one side-end portion 36 is pressed against one terminal surface 18B of the permanent magnet 18, while an interior surface 36B of another side-end portion 36 is pressed against another terminal surface 18B of the permanent magnet 18. Under such a pressed condition, hardening is performed on material which is applied to surround overall circumferences of the U-shape iron core 31 and permanent magnet 18 in a direction along the upper surface 18A of the permanent magnet 18.

As a result, the contact fixing portion 42 fixes the U-shape iron core 31 and permanent magnet 18 in the pressed condition. This prohibits deformation of the U-shape iron core 31 from being released. In FIG. 2, the contact fixing portion 42 directly presses the side-end portions 36 of the U-shape iron core 31. However, the insulation base 12 is not necessarily constructed in such a way, in other words, it is merely necessary to eliminate the gap between the side-end portions 36 and permanent magnet 18. Hence, it is possible to modify the insulation base 12 such that the permanent magnet 18 is fixed to the U-shape iron core 31 by way of the spool 28.

The present embodiment is characterized by that only the shaping of the contact fixing portion 42 brings fixture between the permanent magnet 18 and U-shape iron core 31 while retaining a contact condition between the permanent magnet 18 and the side-end portions 36 of the U-shape iron core 31. In this case, the present embodiment does not at all perform joint operations such as welding and adhesion using adhesive with respect to the permanent magnet 18 and U-shape iron core 31.

Figure 5:
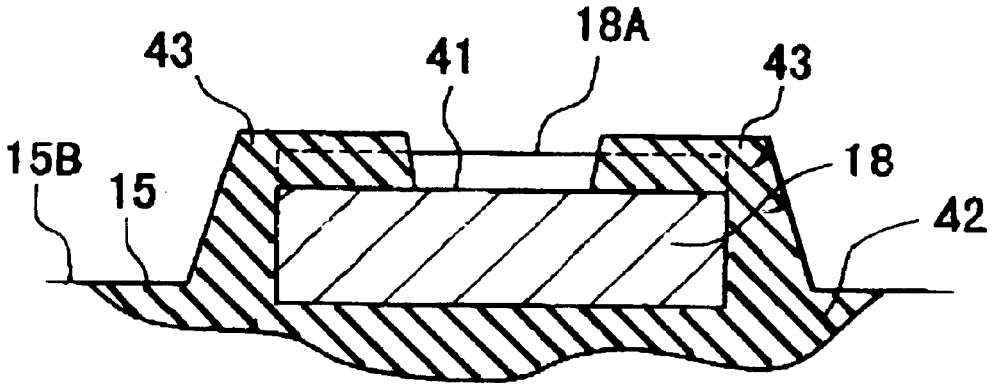
FIG. 5 is a fragmentary expanded sectional view mainly showing a contact fixing portion by which the permanent magnet is fixed to a fixed-side insulator in the insulation base.

As shown in FIGS. 1A, 1B and FIG. 5, the contact fixing portion 42 partially projects upwardly along elongated sides of the permanent magnet 18 from the upper surface 15B of the fixed-side insulator 15. Then, projected portions of the contact fixing portion 42 are bent along the upper surface 18A of the permanent magnet 18 to form four engagement portions 43, which respectively engage with the channels 41 of the permanent magnet 18 being formed to extend in its width direction. That is, as shown in FIG. 1B, each pair of the engagement portions 43 partially engage with each of the channels 41. Due to integral formation of the engagement portions 43, it is possible to prevent the permanent magnet 18 from detaching from the insulation base 12 even if strong impact is applied to the electromagnetic relay 11 being dropped on a floor or else.

2. Armature Block 13

As shown in FIG. 1A, the armature block 13 is constructed by a moving-side insulator 45, a moving-side terminal set 46 and an armature 47. Herein, the moving-side insulator 45 is made of material, which is melted by heating, by integral molding such as injection molding. The moving-side terminal set 46 and armature 47 are partially buried in the moving-side insulator 45, which is being formed by integral molding. Thus, they are held integrally with the moving-side insulator 45.

As shown in FIG. 1A and FIG. 2, the armature 47 is formed in a rectangular parallelepiped shape. A center portion of the armature 47 in its elongated-side direction is fixed to the moving-side insulator 45. As shown in FIG. 2, a support point 48 is formed at a selected position of a lower surface of the center portion of the armature 47.

The moving-side terminal set 46 contains a pair of moving terminals 49, which are arranged outside of the armature 47 in its width direction. Herein, the moving terminals 49 extend along elongated sides of the armature 47.

Each of the moving terminals 49 is held by the moving-side insulator 45 such that a center portion thereof in the elongated-side direction is supported by each of projected sides of the moving-side insulator 45. In addition, the moving terminals 49 are respectively equipped with moving springs 51, 53 having moving contacts 50, 52. Specifically, the moving spring 51 is equipped with the moving contact 50 at a lower end portion thereof and is formed by extending one end of the moving terminal 49, while the moving spring 53 is equipped with the moving contact 52 at a lower end portion thereof and is formed by extending another end of the moving terminal 49. Further, center portions of the moving terminals 49 are equipped with hinge springs 54.

Herein, the hinge spring 54 is formed to extend from the center portion of the moving terminal 49. Thus, the moving contacts 50, 52 are contained in the moving-side terminal set 46.

The armature block 13 is mounted on the insulation base 12 in such a way that the support point 48 formed to project downwardly from the lower surface of the center portion of the armature 47 is brought into contact with the upper surface 18A of the permanent magnet 18. Under such a condition, the armature block 13 is fixed to the insulation base 12 in such a way that the hinge springs 54 of the moving terminals 49 are brought in contact with the support portions 25 of the mid-terminals 22. As described above, the armature block 13 is installed on the permanent magnet 18 of the insulation base 12. In this case, end portions of the armature 47 in its elongated-side direction are arranged opposite to the terminal surfaces 36A of the side-end portions 36 of the U-shape iron core 31. That is, the moving contacts 50 of the moving terminals 49 are arranged to face with the fixed contacts 24 respectively, while the moving contacts 52 of the moving terminals 49 are arranged to face with the fixed contacts 26 respectively. In such an installed condition, the armature block 13 is capable of pivotally moving (or rotating) about the support point 48 on the insulation base 12. In this case, spring forces of the hinge springs 54 are effected in a pivotal movement direction of the armature block 13.

Next, a description will be given with respect to an operating principle of the electromagnetic relay with reference to FIGS. 6A to 6C.

Figures 6A, 6B, 6C:
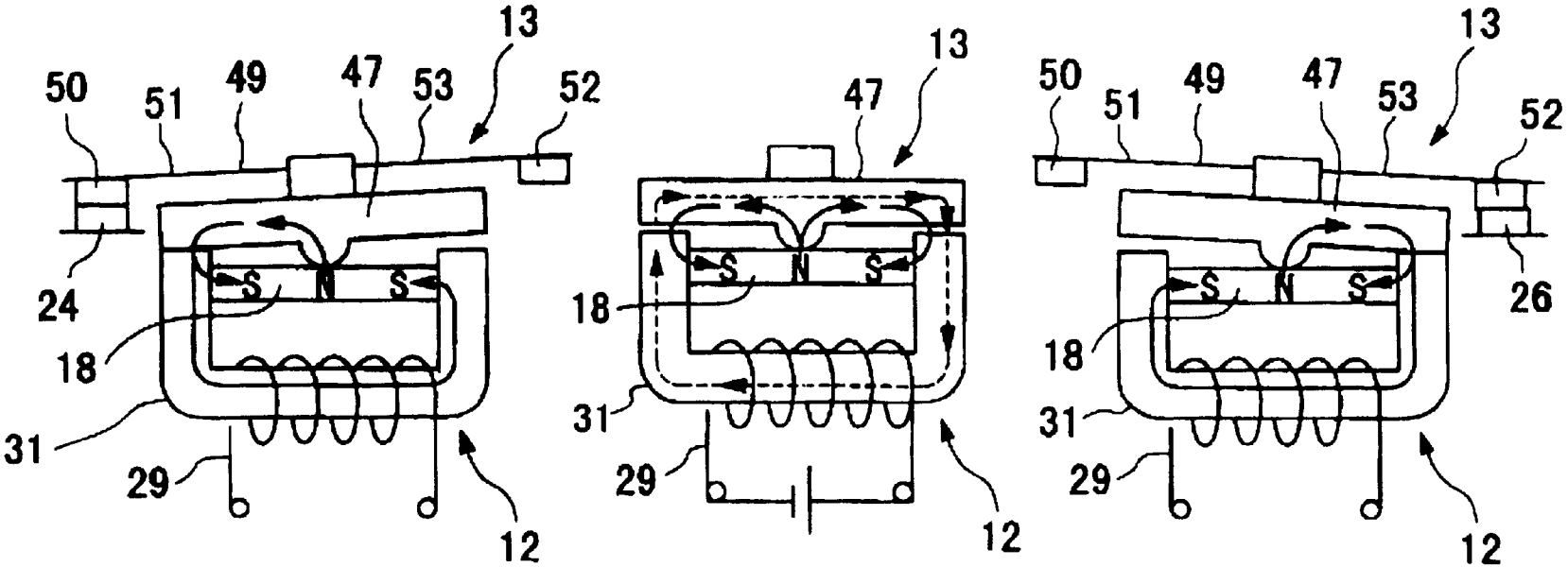
FIG. 6A is a simplified illustration showing a first condition being established between the armature block and insulation base of the electromagnetic relay which is operating.
FIG. 6B is a simplified illustration showing flows of magnetic fluxes being induced in the U-shape iron core and armature by electricity applied to a coil.
FIG. 6C is a simplified illustration showing a second condition being established between the armature block and insulation base of the electromagnetic relay under effects of the magnetic fluxes shown in FIG. 6B.

Reference is made to a first condition shown in FIG. 6A in which the armature block 13 rotatively moves about the support point 48 on the insulation base 12 such that the moving spring 51 of the moving terminal 49 (see left-side of FIG. 6A) moves downwardly to approach one side (or left-side) of the insulation base 12. In such a condition, the moving contact 50 of the moving spring 51 is brought in contact with its corresponding fixed contact 24, while the moving contact 52 of the moving spring 53 leaves apart from its corresponding fixed contact 26. In FIG. 6A, arrows drawn inside of the insulation base 12 show flows of magnetic fluxes being induced in the first condition.

Under the aforementioned condition, when electricity is applied to a coil 29 in which an electric current flows in FIG. 6B, magnetic fluxes are caused to occur and flow through the U-shape iron core 31 and the armature 47 respectively. Due to flows of the magnetic fluxes, some attraction force is caused to occur and works to pivotally move the armature block 13 in such a way that the moving spring 53 moves downwardly against pressing force of the hinge spring 54 (not shown in FIG. 6B) and approaches towards the insulation base 12. Incidentally, the flows of magnetic fluxes are shown by arrows in FIG. 6B, which is simplified in illustration to omit the moving spring 53 of the moving terminal 49.

Thereafter, a second condition shown in FIG. 6C is established between the insulation base 12 and armature block 13. That is, the moving contact 52 of the moving spring 53 is brought into contact with its corresponding fixed contact 26, while the moving contact 50 of the moving spring 51 leaves apart from its corresponding fixed contact 24. In FIG. 6C, arrows show flows of magnetic fluxes being induced in the second condition.

As described above, the contacts are being switched over.

Next, a description will be given with respect to a manufacturing apparatus 56 for manufacturing the insulation base 12 of the electromagnetic relay 11.

Figure 7:
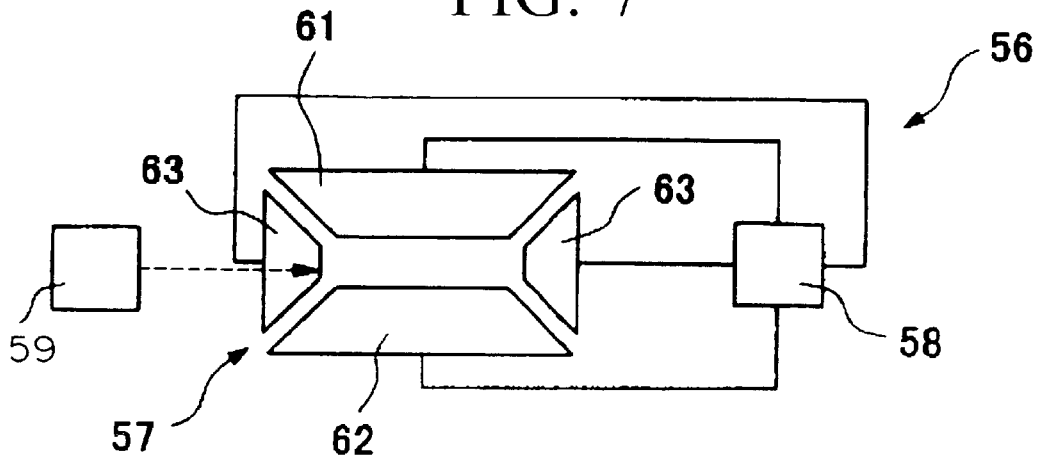
FIG. 7 is a schematic diagram diagrammatically showing a layout of a manufacturing apparatus for manufacturing the insulation base of the electromagnetic relay.

FIG. 7 is a schematic diagram diagrammatically showing a layout of the manufacturing apparatus 56. Namely, the manufacturing apparatus 56 is constructed by a metal mold 57, a clamping device 58 and an injection device 59. Herein, the clamping device 58 clamps the metal mold 57, in which the injection device 59 introduces melted material (e.g., synthesis resin) of the fixed-side insulator 15.

Figure 8:
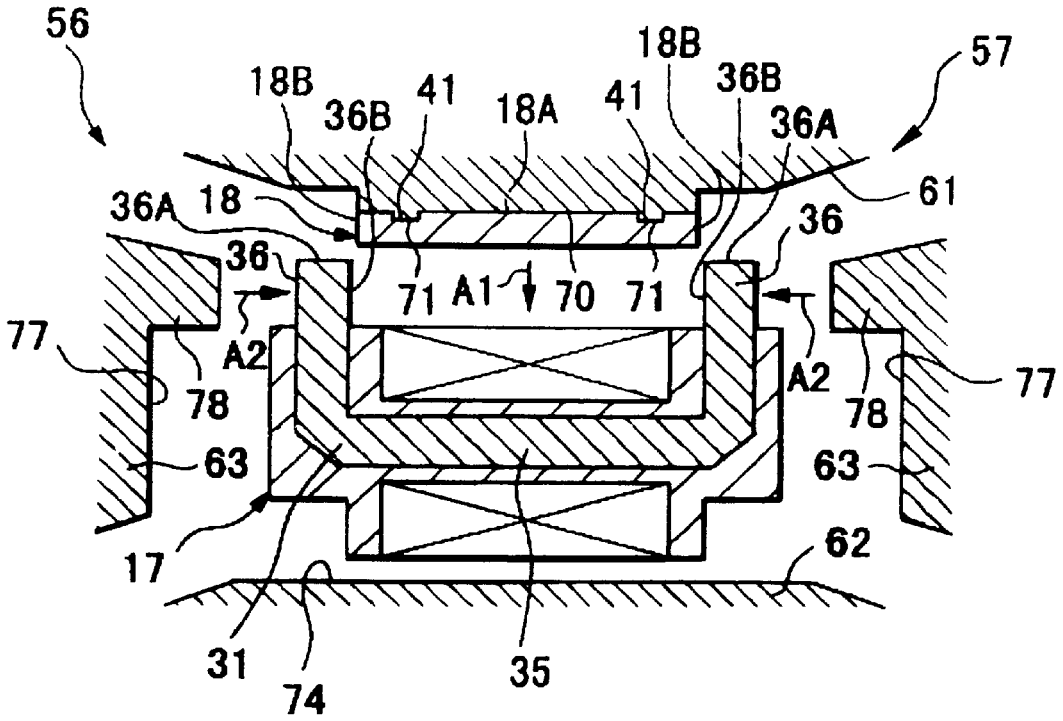
FIG. 8 is an elevational sectional view showing an internal construction of the manufacturing apparatus.

As shown in FIG. 8, the metal mold 57 has an upper mold 61, a lower mold 62 and a pair of side molds 63.

Figure 9:
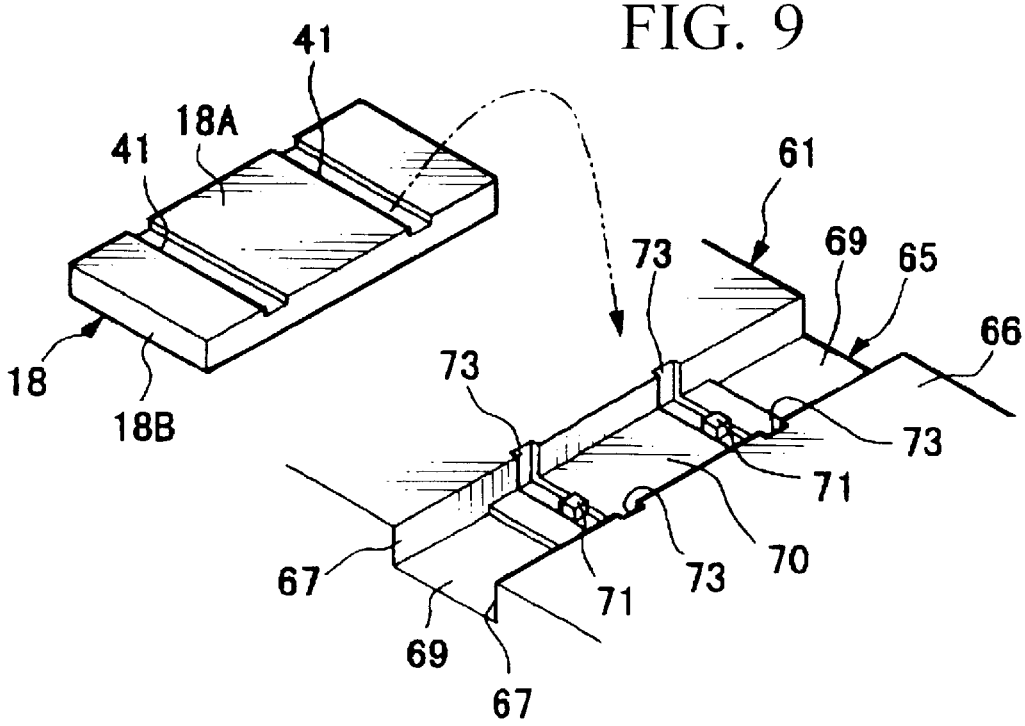
FIG. 9 is a perspective view showing a selected part of an upper mold of a metal mold of the manufacturing apparatus into which a permanent magnet is being inserted.

The upper mold 61 is used to form the upper surface 15B of the fixed-side insulator 15 and its periphery. Herein, the upper mold 61 is held to set prescribed positioning to the permanent magnet 18 being arranged on the upper surface 15B of the fixed-side insulator 15. FIG. 9 shows selected parts of the upper mold 61, which are illustrated in an upside-down manner, as well as the permanent magnet 18. Herein, the upper mold 61 has an upper surface forming portion 66, which is used to form the upper surface 15B of the fixed-side insulator 15. An engagement channel 65 is formed at a center portion of the upper surface forming portion 66 of the upper mold 61. As shown in FIG. 9, the permanent magnet 18 is being inserted into and engaged with the engagement channel 65 of the upper mold 61. Thus, the engagement channel 65 holds the permanent magnet 18 to realize positioning of the permanent magnet 18 in all directions (i.e., elongated-side direction, width direction and thickness direction) in connection with the upper mold 61.

The engagement channel 65 is defined by a pair of side interior walls 67, a pair of first bottom walls 69 and a second bottom wall 70. Herein, the side interior walls 67 are formed opposite to each other and vertically cross a plane of the upper surface forming portion 66 of the upper mold 61. The first bottom walls 69 are arranged in a same plane, which is parallel with the plane of the upper surface forming portion 66. The second bottom wall 70 is sandwiched between the first bottom walls 69 and is formed in a plane, which is slightly shallower than the plane of the first bottom walls 69. A pair of mold projections 71 each having a square prism shape are formed at selected positions of the second bottom wall 70, which are located opposite to each other.

The side interior walls 67 are arranged apart from each other by a certain space, which is used to realize positioning of the permanent magnet 18 being engaged inside of the engagement channel 65 in the width direction.

The mold projections 71 respectively engage with the channels 41 of the permanent magnet 18, which is engaged inside of the engagement channel 65. Herein, the mold projections 71 are located apart from each other by a certain space, which is used to realize positioning of the permanent magnet 18 in its elongated-side direction.

The first bottom walls 69 and the second bottom wall 70 are arranged to provide a certain space, which is used to realize positioning of the upper surface 18A of the permanent magnet 18 being engaged inside of the engagement channel 65 in connection with the terminal surfaces 36A of the side-end portions 36 of the U-shape iron core 31. That is, the terminal surfaces 36A of the side-end portions 36 of the U-shape iron core 31 are brought into contact with the first bottom walls 69 respectively, while the upper surface 18A of the permanent magnet 18 is brought into contact with the second bottom wall 70. Thus, it is possible to realize positioning of the upper surface 18A of the permanent magnet 18 in connection with the terminal surfaces 36A of the side-end portions 36 of the U-shape iron core 31.

When the mold projections 71 of the upper mold 61 are engaged with the channels 41 of the permanent magnet 18, they occupy only selected center areas of the channels 41 of the permanent magnet 18 in its width direction.

Figure 10:
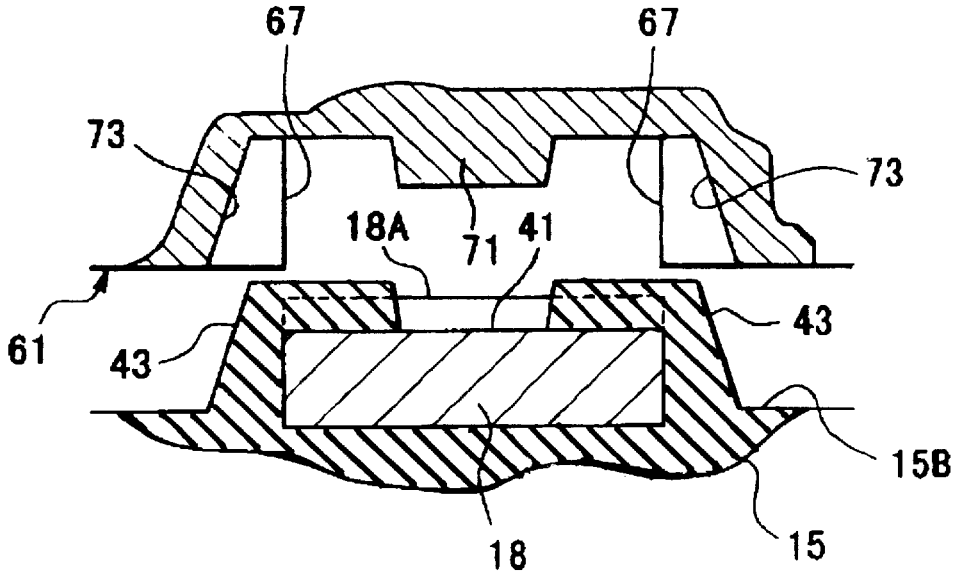
FIG. 10 is a fragmentary expanded sectional view showing selected parts of an upper mold into which a permanent magnet is inserted.

FIG. 10 shows cross sections of the upper mold 61 and permanent magnet 18, which are to be engaged with each other. As shown in FIGS. 9 and 10, channels 73 are formed to extend from exterior portions of the mold projections 71 respectively. That is, two channels 73 are formed to extend from both of exterior portions of the mold projection in a direction traversing the second bottom wall 70 between the side interior walls 67 of the engagement channel 65 of the upper mold 61. Those channels 73 further extend vertically along the side interior walls 67. The channels 73 of the engagement channel 65 of the upper mold 61 act as passages, by which the melted material of the fixed-side insulator 15 being originally introduced into the metal mold 57 is introduced into the channels 41 of the permanent magnet 18 in order to form the aforementioned engagement portions 43 of the insulation base 12.

Moreover, an absorption hole (or absorption holes, not shown) is formed at a certain position of the second bottom wall 70 to absorb the permanent magnet 18 to be attached to the second bottom wall 70. In order to do so, the absorption hole is communicated with a negative pressure (or vacuum) source (not shown).

The lower mold 62 is used to form a lower surface 15C of the fixed-side insulator 15 and its periphery. The lower mold 62 holds the coil block 17, in which the coil 29 is wound about the coil spool 28 in advance, to realize its positioning.

As shown in FIG. 8, the lower mold 62 has a lower surface forming portion 74 for forming the lower surface 15C of the fixed-side insulator 15. Herein, a positioning base (not shown) is formed in the lower mold 62 to realize positioning of the coil block 17 in all directions when the coil block 17 is mounted on a predetermined area of the lower surface forming portion 74.

Figure 11A:
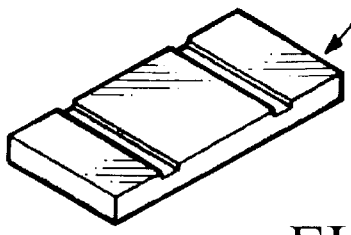
FIG. 11A is a perspective view showing a permanent magnet being set to an upper mold.
Figure 11B:
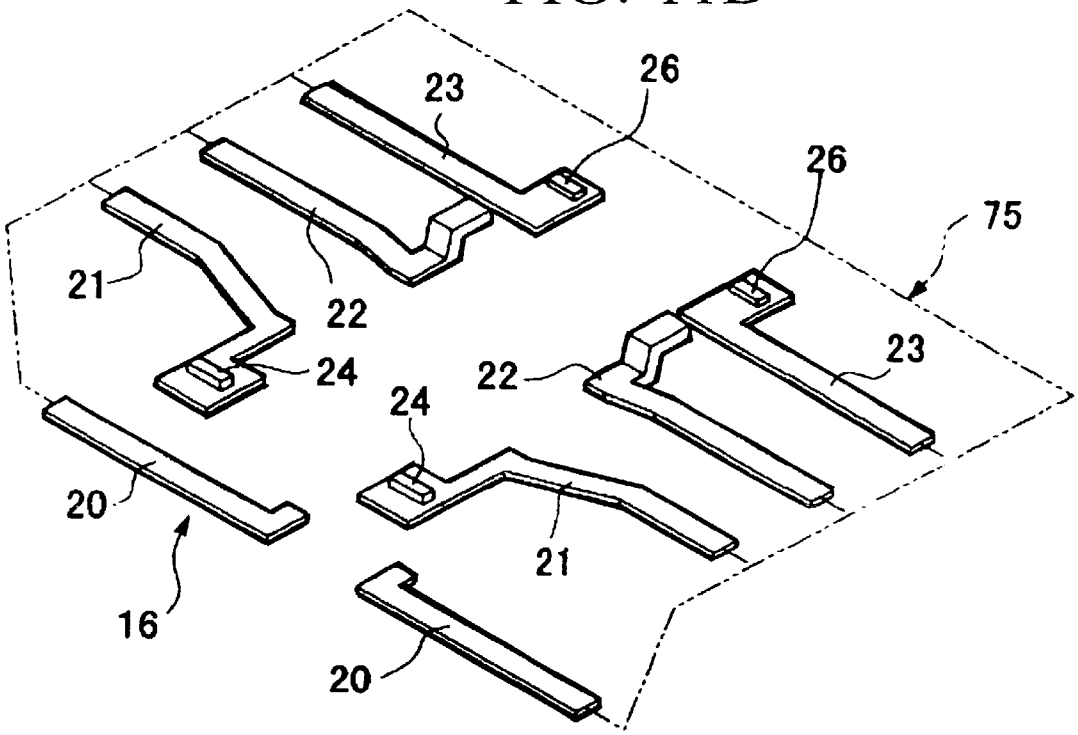
FIG. 11B is an exploded perspective view showing parts of a lead frame being set to a lower mold.
Figure 11C:
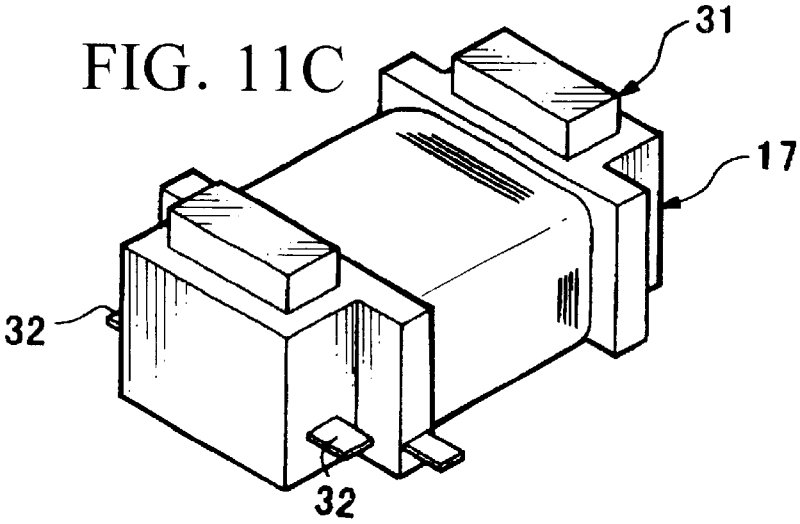
FIG. 11C is a perspective view showing a coil block being set to the lower mold.

Incidentally, FIG. 8 does not contain detailed illustration in which the upper mold 61 and lower mold 62 form side surfaces of the fixed-side insulator 15 in its width direction as well. FIGS. 11A, 11B and 11C are exploded perspective views showing positional relationships between the permanent magnet 18, fixed-side terminal set 16 and coil block 17, which are assembled together by the metal mold 57. Specifically, FIG. 11B shows a lead frame 75, which is constructed by integrally interconnecting all parts of the fixed-side terminal set 16. Herein, the positioning base (not shown) is formed to hold the lead frame 75 in the lower mold 62 while realizing positioning of the lead frame 75 in all directions when the lead frame 75 is mounted on a predetermined area of a mating face (or predetermined areas of mating faces) of the lower mold 62 being mated with the upper mold 61.

Prior to arrangement of the lead frame 75 in the metal mold 57, the lead frame 75 shown in FIG. 11B is fixed to the coil block 17 by welding such that the coil extension terminals 20 are being fixed to the coil terminals 32 of the coil block 17 (see FIG. 11C). As a result, the lead frame 75 is integrally interconnected with the coil block 17. When the coil block 17 and the lead frame 75 which are integrally interconnected together are mounted on the positioning base of the lower mold 62, they are simultaneously subjected to positioning within the lower mold 62. In this case, the coil extension terminals 20 have relatively low rigidity, so the lower mold 62 sets the positioning of the coil block 17.

A pair of the side molds 63 are used to form the terminal surfaces 15A of the fixed-side insulator 15 (see FIG. 2) in its elongated-side direction. They respectively have terminal surface forming portions 77 and press portions 78 as shown in FIG. 8. Herein, the terminal surface forming portions 77 of the side molds 63 form the terminal surfaces 15A of the fixed-side insulator 15 respectively. At a clamping mode (or closing mode), the press portions 78 respectively press the side-end portions 36 of the U-shape iron core 31 in opposite directions. That is, the press portion 78 is brought into contact with a side surface of the side-end portion 36, which is related to the terminal surface 15A, to press the side-end portion 36 by a certain distance in a direction A2.

As shown in FIG. 7, the clamping device 58 is interconnected with the aforementioned upper mold 61, lower mold 62 and side molds 63. Thus, the clamping device 58 performs a mold-close operation and a mold-open operation with respect to the upper mold 61, lower mold 62 and side molds 63 respectively. Herein, the clamping device 58 normally operates the upper mold 61 and lower mold 62 in such a way that the upper surface forming portion 66 and lower surface forming portion 74 are forced to move in parallel with each other. In both of the mold-open operation and mold-close operation, the clamping device 58 operates the upper mold 61 such that the upper mold 61 moves up and down in a vertical direction (i.e., a direction perpendicular to a plane of the upper surface forming portion 66) while being fixed in position in a horizontal direction (i.e., a direction along the plane of the upper surface forming portion 66).

As similar to the upper mold 61, the clamping device 58 operates the lower mold 62 such that the lower mold 62 moves up and down in a vertical direction (i.e., a direction perpendicular to a plane of the lower surface forming portion 74) while being fixed in position in a horizontal direction (i.e., a direction along the plane of the lower surface forming portion 74).

In addition, the clamping device 58 also operates the side molds 63 such that the side molds 63 move close to each other or apart from each other in a horizontal direction (i.e., a direction perpendicular to planes of the terminal surface forming portions 77) while being fixed in positions in a vertical direction (i.e., a direction along the terminal surface forming portions 77).

When a clamping operation is completed, positioning is completed with respect to the upper mold 61, lower mold 62 and side molds 63, in other words, positioning is completed with respect to the metal mold 57 as a whole.

Then, the permanent magnet 18 is set to the engagement channel 65 of the upper mold 61 as shown in FIG. 9. In addition, the coil block 17 and the lead frame 75 are set in the lower mold 62. Thereafter, the clamping device 58 performs a mold-close operation, so that the upper mold 61, lower mold 62 and side molds 63 are moved to approach each other and closed. In the middle of the mold-close operation, the permanent magnet 18 is inserted and engaged between the side-end portions 36 of the U-shape iron core 31 of the coil block 17.

After completion of the mold-close operation, the upper mold 61, lower mold 62 and side molds 63 are set in prescribed positions. Herein, the permanent magnet 18 is held by the upper mold 61 to realize positioning thereof, while the coil block 17 (specifically, U-shape iron core 31) and lead frame 75 (specifically, fixed-side terminal set 16) are held in the lower mold 62 to realize positioning thereof. Thus, total positioning of the permanent magnet 18, coil block 17 and lead frame 75 is made with respect to the metal mold 57.

Figure 12:
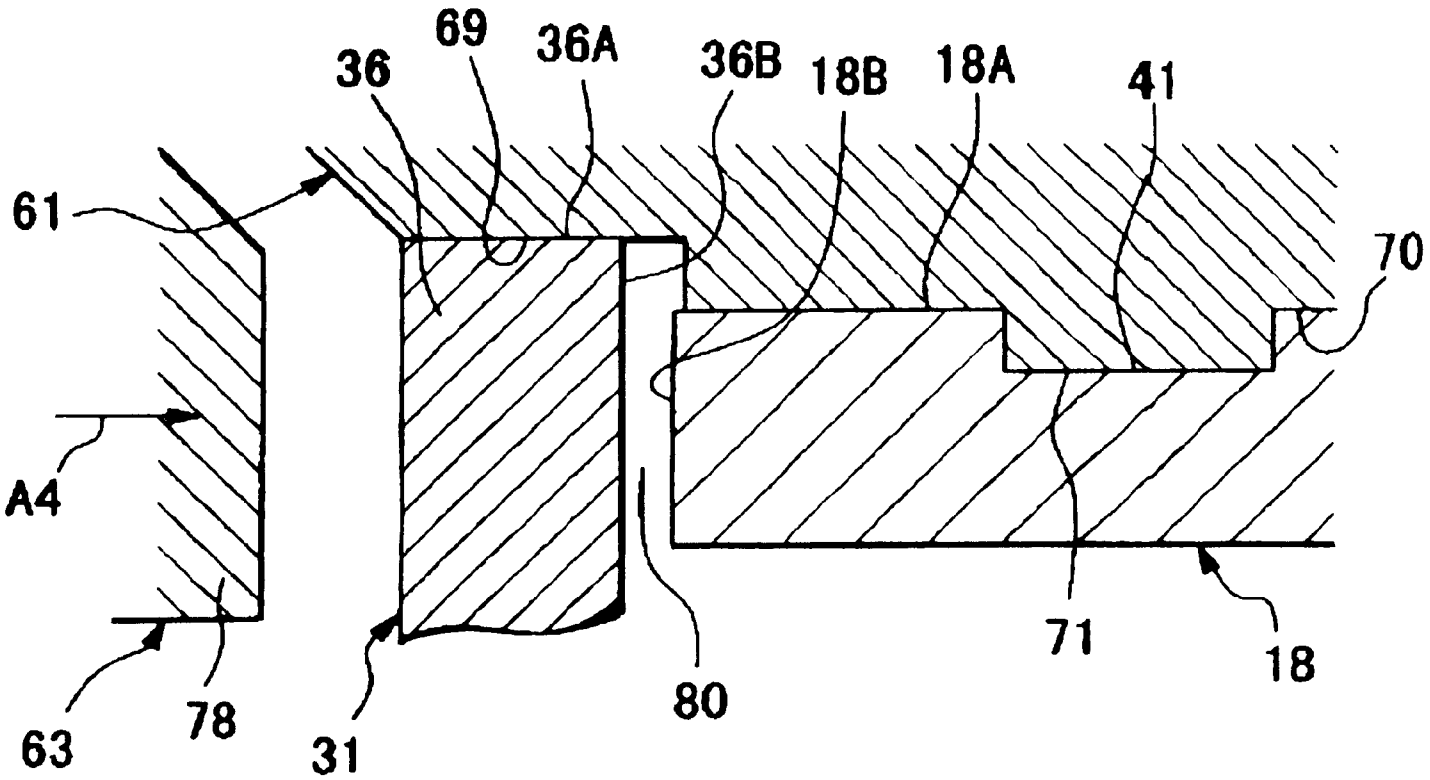
FIG. 12 is a fragmentary expanded sectional view showing a side-end portion of a U-shape iron core and its corresponding part of a permanent magnet, which are being fixed together by an upper mold and a side mold in a clamping operation.

Details of operations of the clamping device 58 will be described with reference to FIG. 12, which shows selected parts of the U-shape iron core 31 of the coil block 17 in view of one of the side-end portions 36. In a mold-close operation of the clamping device 58, the permanent magnet 18 is inserted and engaged between the side-end portions 36 of the U-shape iron core 31 of the coil block 17. In this case, small gaps are needed respectively between the side-end portions 36 and the terminal surfaces 18B of the permanent magnet 18 in order to perform insertion and engagement of the permanent magnet 18 between the side-end portions 36 of the U-shape iron core 31. FIG. 12 shows only a small gap 80 which is provided between the interior surface 36B of the side-end portion 36 and the terminal surface 18B of the permanent magnet 18. Then, the clamping device 58 works to eliminate the gaps between the side-end portions 36 and the permanent magnet 18. That is, the clamping device 58 operates the metal mold 57 and moves the side molds 63 to press exterior walls of the side-end portions 36 of the U-shape iron core 31 with the press portions 78 respectively. Thus, the U-shape iron core 31 is deformed in a lateral direction (A4) so that the side-end portions 36 are respectively brought into contact with the terminal surfaces 18B of the permanent magnet 18. As a result, at completion of the mold-close operation, both of the side-end portions 36 of the U-shape iron core 31 of the coil block 31 are simultaneously placed in contact with the terminal surfaces 18B of the permanent magnet 18.

At the completion of the mold-close operation, the terminal surfaces 36A of the side-end portions 36 of the U-shape iron core 31 are completely brought into contact with the first bottom walls 69 of the upper mold 61. As a result, it is possible to set vertical positioning of the terminal surfaces 36A of the side-end portions 36 of the U-shape iron core 31 in connection with the permanent magnet 18 whose upper surface 18A is placed in contact with the second bottom wall 70 in the thickness direction of the permanent magnet 18.

Due to the completion of the mold-close operation, a cavity whose shape corresponds to a shape of the fixed-side insulator 15 is being formed inside of the metal mold 57. This cavity includes spaces, which are formed between the channels 41 of the permanent magnet 18 and the channels 73 including the mold projections 71 of the upper mold 61 shown in FIG. 9.

After the completion of the mold-close operation, the clamping device 58 starts to perform a mold-open operation. In this case, the claming device 58 operates all of the upper mold 61, lower mold 62 and side molds 63 to move being apart from each other. In the mold-open operation, the insulation base 12 being manufactured remains in the lower mold 62. The clamping device 58 has an extrusion device (not shown), which operates being interlocked with the mold-open operation. That is, the extrusion device operates to extrude the insulation base 12 to leave from the lower mold 62.

As described before, the material of the fixed-side insulator 15 is melted by heating. The injection device 59 injects the melted material of the fixed-side insulator 15 into the cavity of the metal mold 57.

Next, a description will be given with respect to a manufacturing method of the electromagnetic relay 11.

Figure 13:
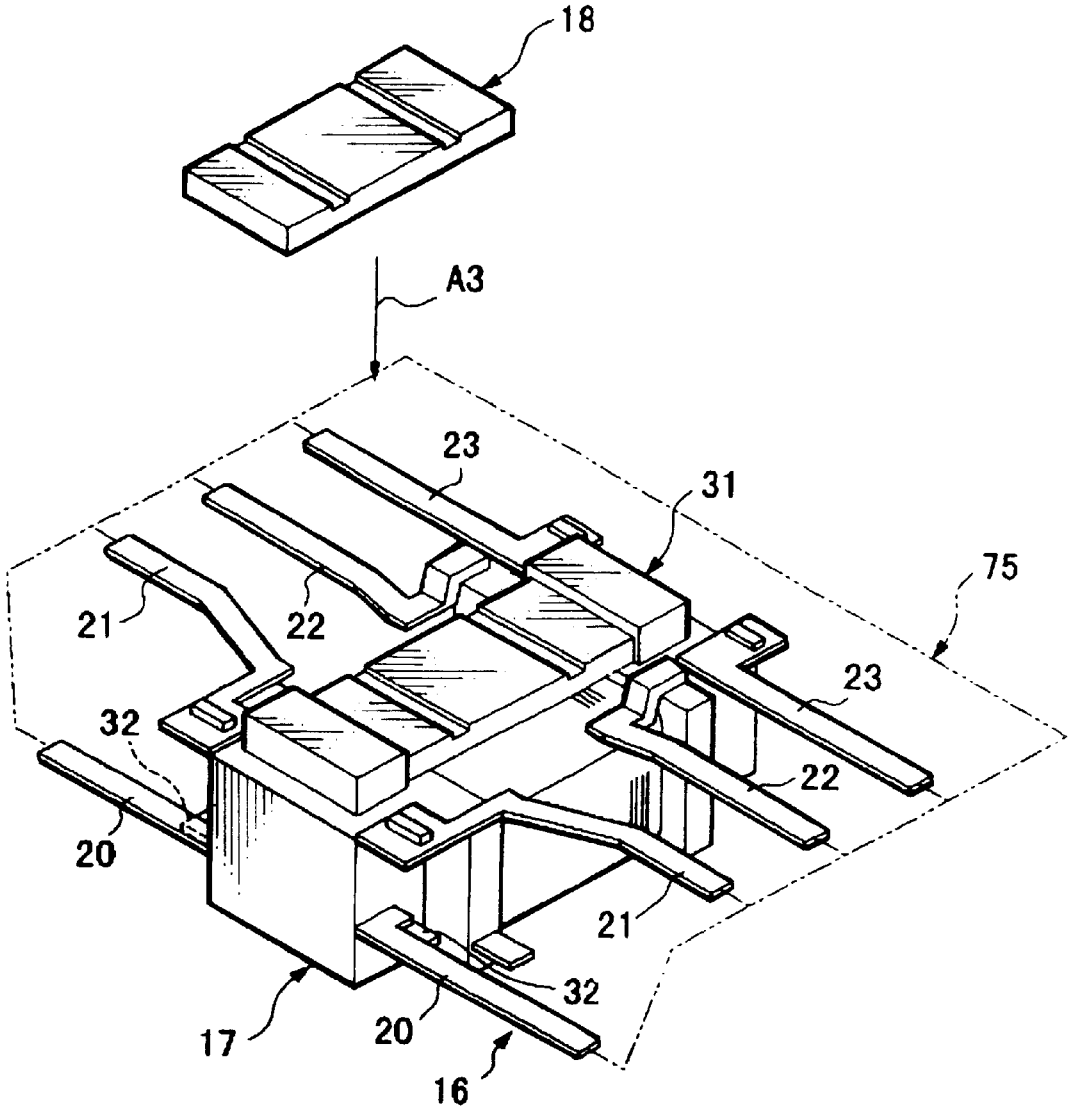
FIG. 13 is a perspective view showing a permanent magnet, a coil block and a lead frame before their arrangement into a metal mold.

First, as shown in FIG. 13, the coil extension terminals 20 of the lead frame 75 are attached to the coil terminals 32 of the coil block 17 by welding. Thus, the lead frame 75 is firmly and integrally fixed to the coil block 17. This work is irrelevant to the aforementioned manufacturing device 56 and is performed independently of steps regarding the manufacturing device 56.

Then, an arrangement step is performed as follows:

A joint unit corresponding to the lead frame 75 and coil block 17 which are integrally connected with each other in advance is arranged at a predetermined area of the positioning base (not shown) of the lower mold 62 of the metal mold 57, which is placed in a mold-open condition as shown in FIG. 8. In addition, the permanent magnet 18 is arranged inside of the engagement channel 65 of the upper mold 61 such that the mold projections 71 engage with the channels 41 of the permanent magnet 18 as shown in FIG. 9.

Figure 14:
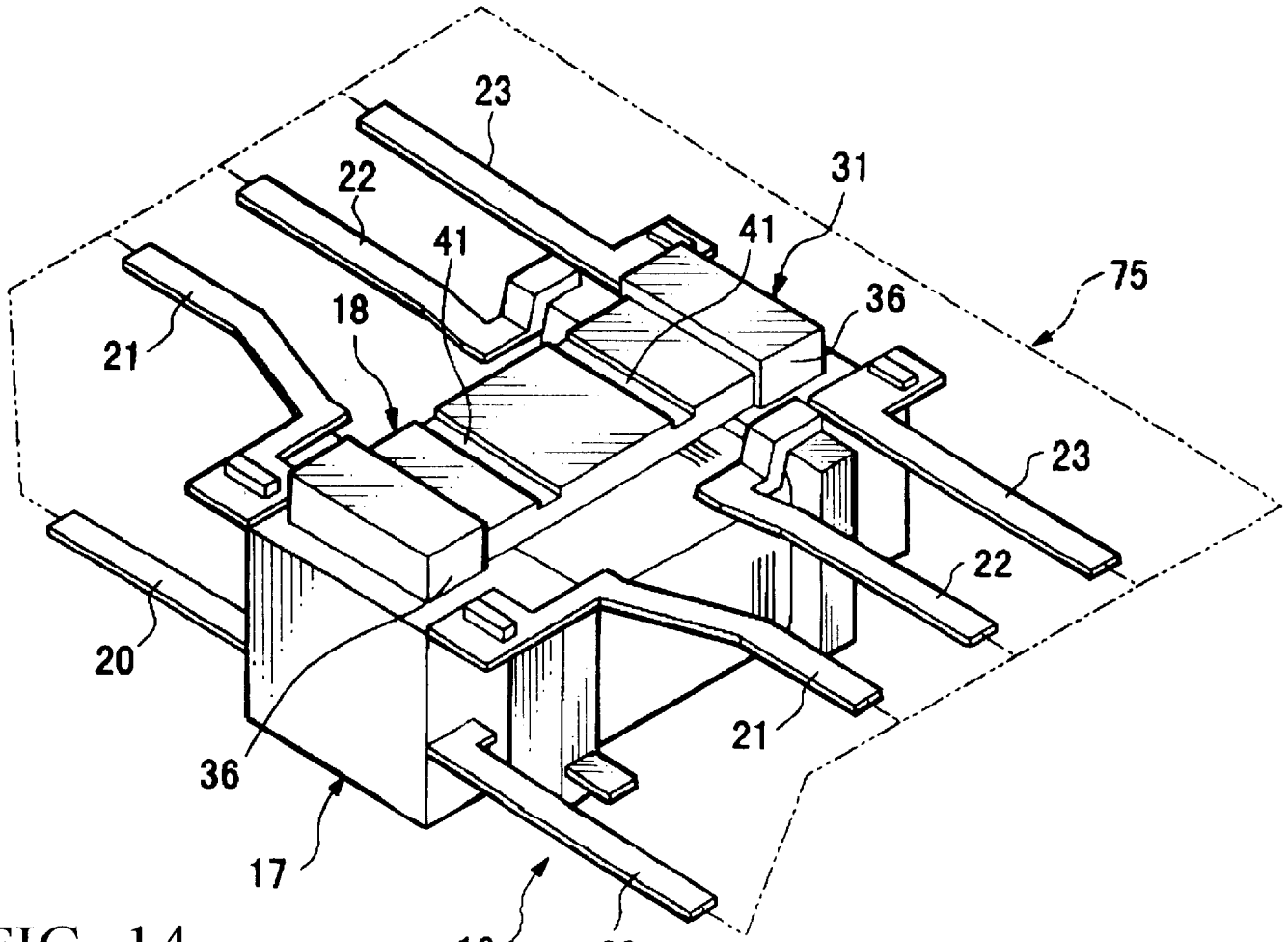
FIG. 14 is a perspective view showing the coil block and lead frame which are fixed together by a clamping step.

Due to the arrangement step, all of the permanent magnet 18, lead frame 75 and coil block 17 are arranged inside of the metal mold 57 at the prescribed positions. Next, a human operator starts the manufacturing device 57 so that the clamping device 58 performs a mold-close operation with respect to the metal mold 57. That is, the upper mold 61 moves downwardly in a direction A1, while the side molds 63 move horizontally in directions A2 (see FIG. 8). Thus, the permanent magnet 18 is moved in a direction A3 (see FIG. 13), so that it is inserted and engaged between the side-end portions 36 of the U-shape iron core 31. Thereafter, the clamping device 58 performs a clamping step (or mold-close operation) as follows:

The clamping device 58 moves the side molds 63 horizontally (see an arrow A4 in FIG. 12), so that the side molds 63 press the exterior walls of the side-end portions 36 of the U-shape iron core 31 with the press portions 78. The U-shape iron core 31 is deformed to eliminate gaps (e.g., gap 80 shown in FIG. 12) which are provided between the interior walls 36A of the side-end portions 36 and the terminal surfaces 18B of the permanent magnet 18 respectively. Thus, it is possible to establish a contact condition in which the side-end portions 36 are placed in contact with the permanent magnet 18. Under such a contact condition, the permanent magnet 18, lead frame 75 and coil block 17 are fixedly installed in the metal mold 57 at the prescribed positions. In addition, clamping is performed to form a cavity which corresponds to the shape of the fixed-side insulator 15 in the metal mold 57. FIG. 14 shows interconnections between the permanent magnet 18, lead frame 75 and coil block 17, which are made in the metal mold 57 when the clamping step is completed.

After completion of the clamping step, the manufacturing device 56 controls the clamping device 58 to maintain a clamping condition of the metal mold 57. At this time, the injection device 59 introduces the melted material of the fixed-side insulator 15 into the cavity being formed inside of the metal mold 57. Thus, it is possible to perform a material introduction step to integrally form the fixed-side insulator 15.

Figure 15:
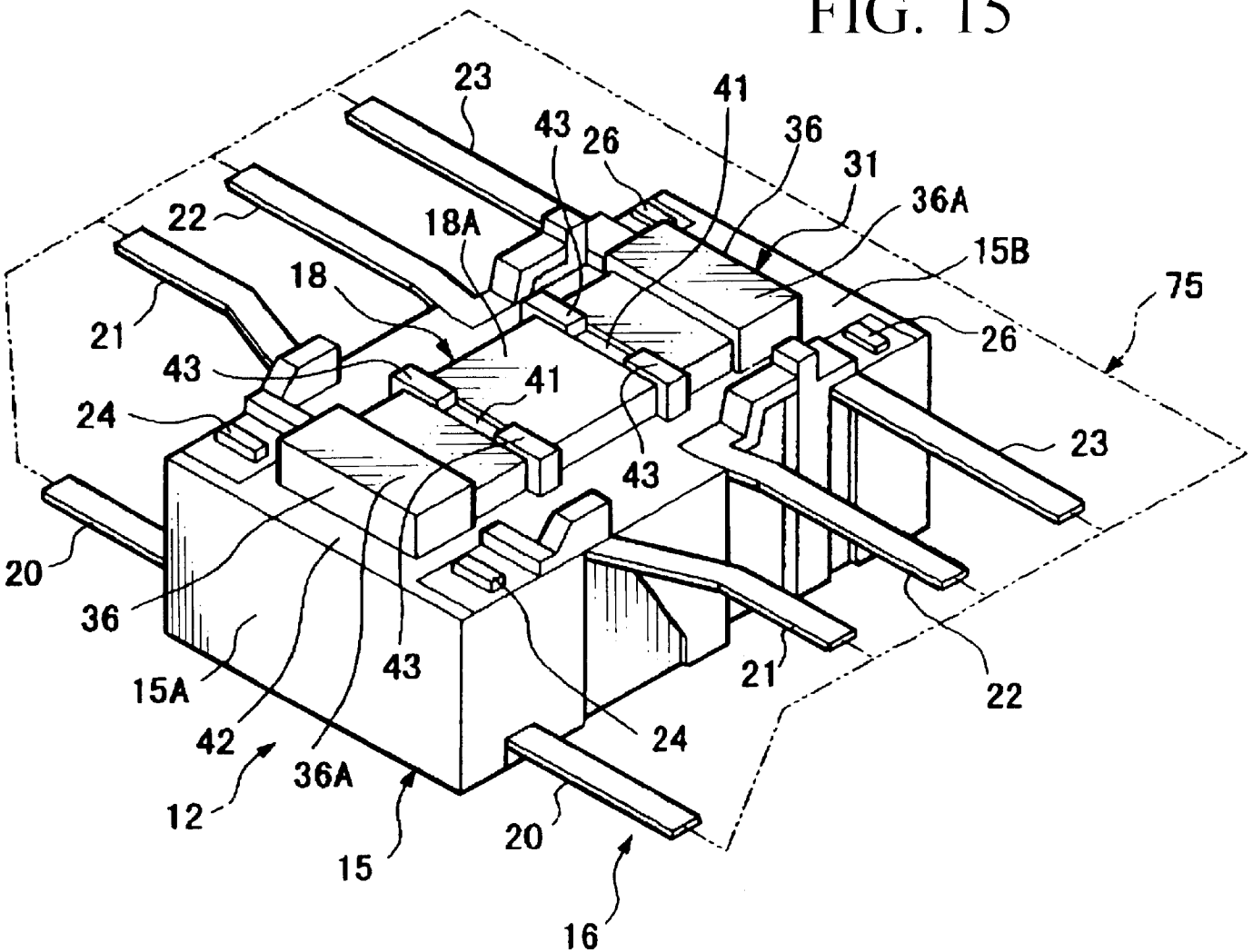
FIG. 15 is a perspective view showing an insulation base after formation of a fixed-side insulator by a material introduction step.

Then, the material of the fixed-side insulator 15 being filled in the cavity of the metal mold 57 is hardened by cooling. Thereafter, the manufacturing device 56 controls the clamping device 58 to perform a mold-open operation on the metal mold 57. Interlocked with the mold-open operation, the clamping device 58 operates the extrusion device so that the insulation base 12 separates from the lower mold 62. FIG. 15 shows the insulation base 12 just after separation from the lower mold 62.

Figure 16:
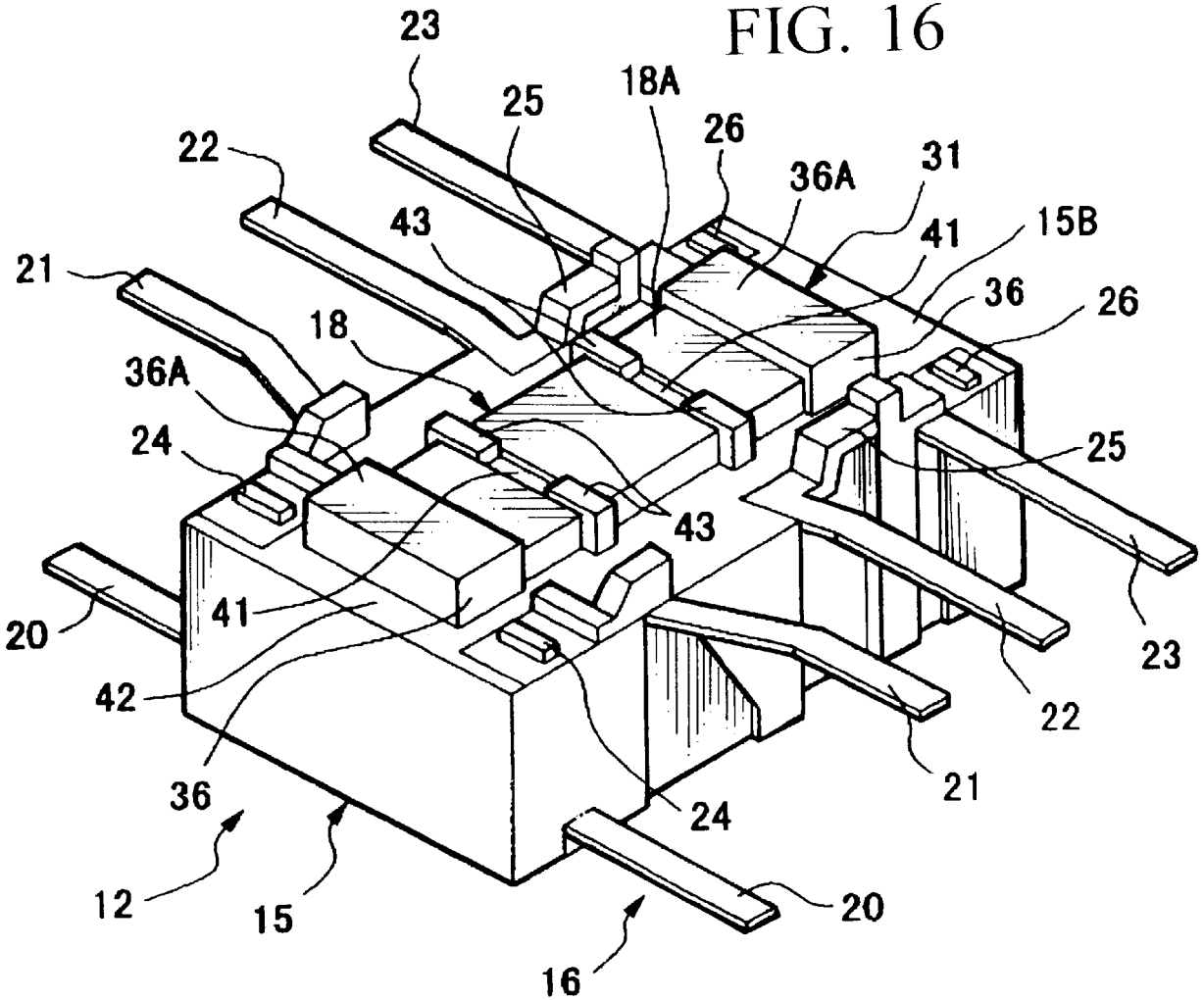
FIG. 16 is a perspective view showing the insulation base after formation of a fixed-side terminal set from the lead frame by a press working step.
Figure 17:
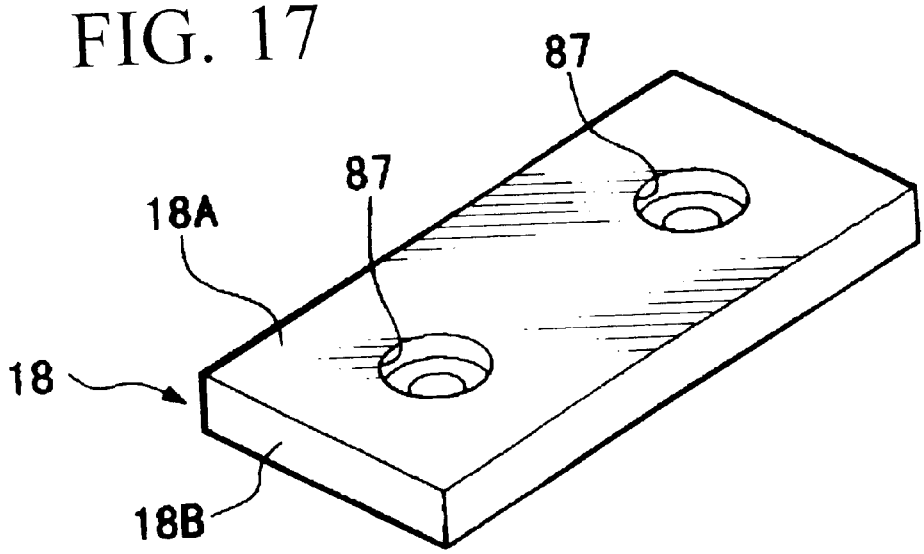
FIG. 17 is a perspective view showing a permanent magnet which is designed in accordance with a first modified example.

Thereafter, the manufacturing device 56 operates a press device (not shown) to perform a press working step, as follows:

With respect to the insulation base 12 which is separated from the lower mold 62, the press device cuts out unwanted parts of the lead frame 75 to form the fixed-side terminal set 16, i.e., the coil extension terminals 20, fixed terminals 21, mid-terminals 22 and fixed terminals 23, which are separated from each other. FIG. 16 shows the insulation base 12 after formation of the terminals 20–23. Then, the press device bends and folds the coil extension terminals 20, fixed terminals 21, mid-terminals 22 and fixed terminals 23. Thus, it is possible to manufacture the insulation base 12 shown in FIG. 1B.

Moreover, the contact fixing portion 42 having the engagement portions 43 is formed integrally with the fixed-side insulator 15. Herein, the engagement portions 43 are placed being partially engaged with the channels 41 of the permanent magnet 18. In addition, the engagement portions 43 are provided to fix the U-shape iron core 31 and permanent magnet 18 together while maintaining the contact condition where the permanent magnet 18 is placed in contact with the side-end portions 36 of the U-shape iron core 31 of the coil block 17.

An assembling device (not shown) installs the armature block 13 in the insulation base 12. Further, the insulation base 12 is covered with an insulating cover (not shown). Thus, it is possible to completely produce the electromagnet relay 11.

In short, the present embodiment is designed to perform steps as follows:

In the clamping step of the clamping device 58, the permanent magnet 18 is inserted and engaged between the side-end portions 36 of the U-shape iron core 31, then, the metal mold 57 presses the exterior walls of the side-end portions 36 to establish a contact condition where the permanent magnet 18 is placed in contact with the side-end portions 36. Then, the coil block 17 including the permanent magnet 18 and U-shape iron core 31, which are placed in the contact condition, and the lead frame 75 including the fixed-side terminal set 16 are fixed in the metal mold 57 at prescribed positions. In addition, a cavity corresponding to the shape of the fixed-side insulator 15 is formed inside of the metal mold 57. Then, the material introduction step is performed to introduce the melted material of the fixed-side insulator 15 into the cavity of the metal mold 57 by the injection device 59. Thus, all parts of the fixed-side insulator 15 are formed integrally. When the fixed-side insulator 15 is completely hardened, the contact fixing portion 42 is formed integrally with the fixed-side insulator 15 and is provided to fix the permanent magnet 18 and U-shape iron core 31 together while maintaining the contact condition where the permanent magnet 18 is placed in contact with the side-end portions 36 of the U-shape iron core 31.

As described above, it is repeated that due to integral molding of the fixed-side insulator 15, the contact fixing portion 42 is formed to fix the permanent magnet 18 and U-shape iron core 31 at the prescribed positions while maintaining the contact condition where the permanent magnet 18 is placed in contact with the side-end portions 36 of the U-shape iron core 31. This eliminates necessity to perform welding or adhesion using the adhesive because the permanent magnet 18 is fixed in position to be in contact with the side-end portions 36 of the U-shape iron core 31. In addition, it is possible to prevent the side-end portions 36 from melting due to sputters of the welding, and it is unnecessary to provide a wait time, which is conventionally needed for hardening of the adhesive. Therefore, it is possible to maintain the side-end portions 36 in good shapes, so it is possible to provide good contacts with respect to the armature 47 of the armature block 13. In addition, it is possible to reduce magnetic resistance between the U-shape iron core 31 and armature 47. As a result, it is possible to improve yield in manufacturing the electromagnetic relays, and it is possible to improve productivity in manufacturing the products by eliminating the unwanted wait time.

In addition, the melted material of the fixed-side insulator 15 is introduced into the metal mold 57 under the contact condition where the metal mold 57 presses the exterior walls of the side-end portions 36 of the U-shape iron core 31 so that the permanent magnet 18 is firmly brought into contact with the side-end portions 36 of the U-shape iron core 31. This prevents insulating material from entering into spaces between the permanent magnet 18 and the side-end portions 36 of the U-shape iron core 31. In other words, it is possible to prevent insulating layers (e.g., resin burrs) from forming in the spaces between the permanent magnet 18 and the side-end portions 36 of the U-shape iron core 31. As a result, it is possible to reduce magnetic resistance between the permanent magnet 18 and U-shape iron core 31. That is, it is possible to avoid reduction of the yield due to increasing magnetic resistance between them.

Further, all of the fixed-side terminal set 16, coil block 17 including the U-shape iron core 31, and the permanent magnet 18 are fixed to the fixed-side insulator 15 by its integral molding. In addition, the permanent magnet 18 is fixed to the U-shape iron core 31 because of the integral molding of the fixed-side insulator 15. Conventionally, a joint unit is made by jointing the permanent magnet 18 and U-shape iron core 31 together in advance, then, such a joint unit and the fixed-side terminal set 16 are fixed to the fixed-side insulator 15 by its integral molding. As compared with such a conventional technique, the present embodiment is capable of simplifying steps in manufacturing the electromagnetic relays, so it is possible to improve productivity in making the products.

Moreover, it is repeated that all of the fixed-side terminal set 16, coil block 17 including the U-shape iron core 31, and permanent magnet 18 are fixed to the fixed-side insulator 15 by its integral molding, wherein the permanent magnet 18 is fixed to the U-shape iron core 31 by the integral molding of the fixed-side insulator 15. So, it is possible to improve an accuracy in positioning of the fixed-side terminal set 16, U-shape iron core 31 and permanent magnet 18.

Concretely speaking, a joint unit is made by jointing the permanent magnet 18 and U-shape iron core 31 together in advance, wherein positioning errors are caused to occur between the permanent magnet 18 and U-shape iron core 31. Then, the joint unit and fixed-side terminal set 16 are fixed to the fixed-side insulator 15 by its integral molding. In this case, if the joint unit is positioned on the basis of the terminal surfaces 36A of the side-end portions 36 of the U-shape iron core 31 in the metal mold 57, initial positioning of the permanent magnet 18 already includes errors being deviated from the terminal surfaces 36A. Those errors deteriorate an accuracy in positioning of the mid-terminals 22, which is made based on the upper surface 18A of the permanent magnet 18, in a vertical direction. For example, dispersion occurs in pressing force of the armature 47 due to contact and fixture of the mid-terminals 22 by the hinge springs 54 of the armature block 13, which is placed in contact with the upper surface 18A of the permanent magnet 18. This causes variations in operating voltage of the electromagnetic relay. If the joint unit is positioned on the basis of the upper surface 18A of the permanent magnet 18 in the metal mold 57, initial positioning of the U-shape iron core 31 already includes errors being deviated from the upper surface 18A. Those errors deteriorate an accuracy in positioning of the fixed contacts 24 and 26, which is made based on the terminal surfaces 36A of the side-end portions 36 of the U-shape iron core 31, in a vertical direction. Normally, when the armature 47 is brought into contact with the terminal surface 36A of the side-end portion 36 of the U-shape iron core 31, the moving contacts 50 (or 52) come in contact with the fixed contacts 24 (or 26). However, deterioration of the accuracy of positioning of the fixed contacts badly influence positional relationships between the moving contacts and fixed contacts in vertical directions, so defectiveness may be caused to occur in contact between them. In short, the electromagnetic relay should be damaged in electric characteristics due to deterioration of the accuracy in vertical positioning of the mid-terminals 22 and deterioration of the accuracy in vertical positioning of the fixed contacts 24, 26. The present embodiment is capable of coping with the aforementioned drawbacks because of the integral molding. That is, it is possible to guarantee a high accuracy in vertical positioning of the mid-terminals 22 based on the upper surface 18A of the permanent magnet 18, and it is possible to guarantee a high accuracy in vertical positioning of the fixed contacts 24, 26 based on the terminal surfaces 36A of the side-end portions 36 of the U-shape iron core 31.

In addition, the channels 41 are formed at the prescribed positions of the permanent magnet 18 in connection with the armature block 13, while the mold projections 71 are formed at the prescribed positions of the upper mold 61 of the metal mold 57 to engage with the channels 41 respectively. Using the channels 41 and mold projections 71 which are engaged with each other, it is possible to realize positioning of the permanent magnet 18 in the metal mold 57. Therefore, it is possible to accurately insert and engage the permanent magnet 18 between the side-end portions 36 of the U-shape iron core 31 in the clamping step.

Further, by letting the melted material of the fixed-side insulator 15 to flow into the channels 41 of the permanent magnet 18, it is possible to form the engagement portions 43 from the contact fixing portion 42, wherein the engagement portions 43 are formed to have the prescribed shapes that partially engage with the channels 41 of the permanent magnet 18 being inserted between the side-end portions 36 of the U-shape iron core 31. Therefore, by using the channels 41 that are originally used for the positioning of the permanent magnet 18 in the metal mold 57, it is possible to form the contact fixing portion 43 engaging with the permanent magnet 18 in connection with the armature block 13 with ease. Thus, it is possible to provide a superior structure for certainly fixing the permanent magnet 18 to the coil block 17 including the U-shape iron core 31 in the insulation base 12.

The present embodiment can be modified in a variety of designs, which will be described below.

1. FIRST MODIFIED EXAMPLE

A first modified example will be described with reference to FIGS. 17 to 20. The first modified example is characterized by forming a pair of positioning holes 87, which are arranged at positions in the elongated-side direction of the permanent magnet 18. Those holes 87 penetrate through the permanent magnet 18 vertically in its thickness direction. Herein, each of the positioning holes 87 has a staged shape consisting of a large aperture portion 88 and a small aperture portion 89. The large aperture portion 88 is formed in proximity to the upper surface 18A of the permanent magnet 18 in connection with the armature block 13, while the small aperture portion 89 whose aperture is smaller than the large aperture portion 88 is formed in proximity to a bottom surface (not shown) which is a reverse side of the upper surface 18A of the permanent magnet 18.

Figure 18:
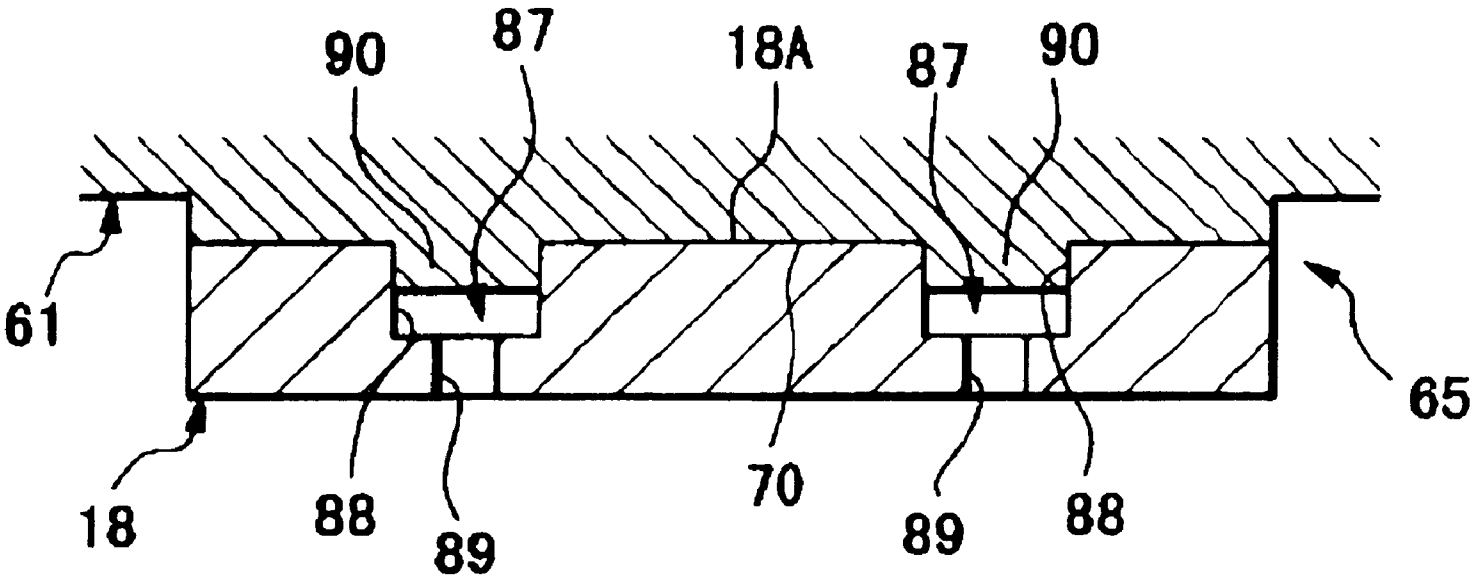
FIG. 18 is a fragmentary expanded sectional view showing an upper mold and the permanent magnet which are engaged with each other in accordance with the first modified example.
Figure 19:
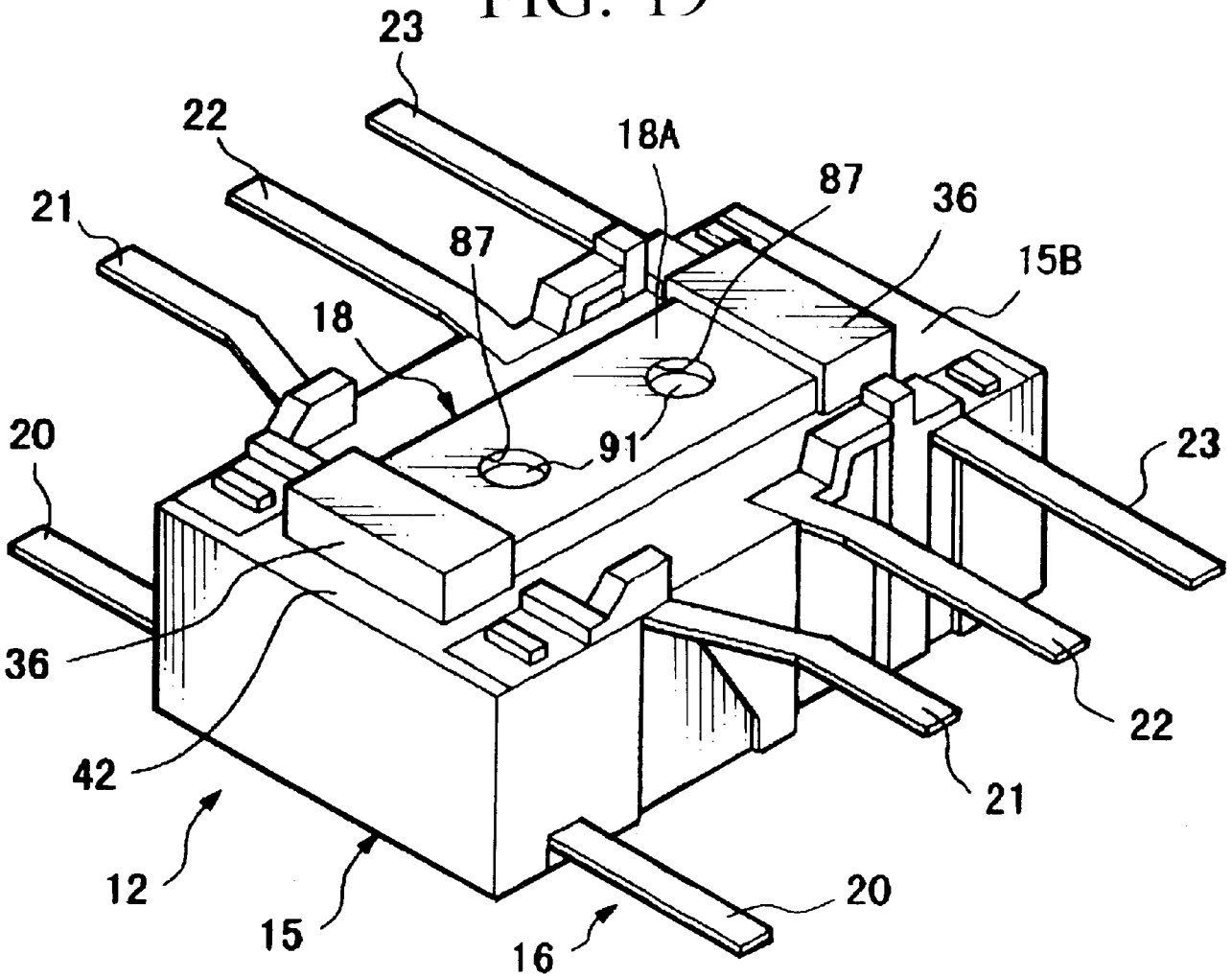
FIG. 19 is a perspective view showing an insulation base which is manufactured in accordance with the first modified example.

On the second bottom wall 70 of the engagement channel 65 of the upper mold 61 shown in FIG. 18, a pair of mold projections 90 each having a cylindrical shape are formed and arranged in connection with the pair of positioning holes 87 of the permanent magnet 18. That is, the mold projections 90 are arranged apart from each other by a certain interval of distance to engage with the positioning holes 87, so that positioning of the permanent magnet 18 is performed in the elongated-side direction. When the mold projections 90 are placed to engage with the positioning holes 87 of the permanent magnet 18 as shown in FIG. 18, they occupy only upper portions of the large aperture portions 88 inside of the positioning holes 87.

Figure 20:
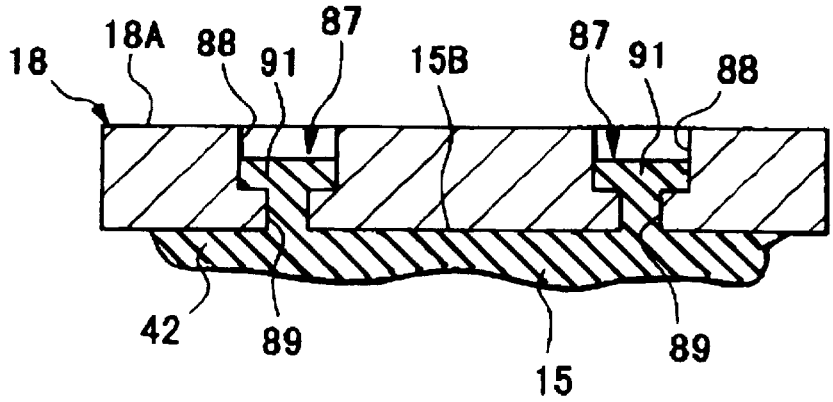
FIG. 20 is a fragmentary expanded sectional view showing engagement portions which are formed from a contact fixing portion of a fixed-side insulator to engage with positioning holes of the permanent magnet in the first modified example.

Under a condition where the permanent magnet 18 is firmly set inside of the engagement channel 65 of the upper mold 61, the manufacturing device 56 operates the clamping device 58 to execute a clamping step for clamping the metal mold 57. Then, a material introduction step is executed to introduce the melted material of the fixed-side insulator 15 into the cavity of the metal mold 57 by the injection device 59. At this time, the melted material is introduced into the small aperture portions 89 as well as unoccupied portions of the large aperture portions 88 in the positioning holes 87 of the permanent magnet 18. As a result, engagement portions 91 are formed integrally with the contact fixing portion 42 of the fixed-side insulator 15. Herein, as shown in FIG. 20, the engagement portions 91 are formed to suit to the small aperture portions 89 and unoccupied portions of the large aperture portions 88 of the positioning holes 87 of the permanent magnet 18.

In the above, the positioning holes 87 are formed to penetrate through the permanent magnet 18 in connection with the armature block 13, which is being mounted on the insulation base 12. In addition, the mold projections 90 engaging with the positioning holes 87 of the permanent magnet 18 are formed on the second bottom wall 70 of the upper mold 61 of the metal mold 57. Using the positioning holes 87 and mold projections 90 which are placed to engage with each other, it is possible to set positioning of the permanent magnet in the metal mold 57. Thus, in the clamping step, it is possible to accurately insert and engage the permanent magnet 18 between the side-end portions 36 of the U-shape iron core 31.

By letting the melted material of the fixed-side insulator 15 to flow into the positioning holes 87 of the permanent magnet 18, it is possible to form the engagement portions 91 from the contact fixing portion 42, wherein the engagement portions 91 are formed to have prescribed shapes that partly engage with the positioning holes 87 of the permanent magnet 18. Therefore, by using the positioning holes 87, it is possible to provide a superior structure in which the contact fixing portion 42 is partly engaged with the permanent magnet 18 so that the permanent magnet 18 is certainly fixed to the U-shape iron core 31 with ease.

2. SECOND MODIFIED EXAMPLE

Figure 21:
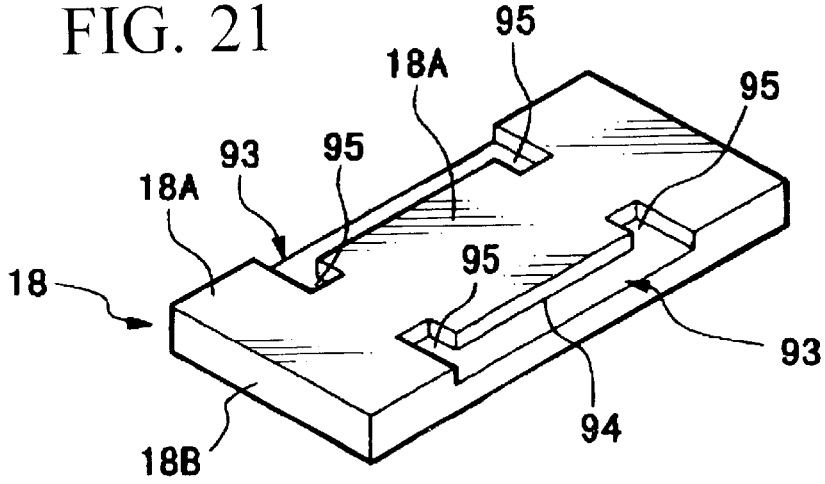
FIG. 21 is a perspective view showing a permanent magnet having cut sections, which is formed in accordance with a second modified example.
Figure 22:
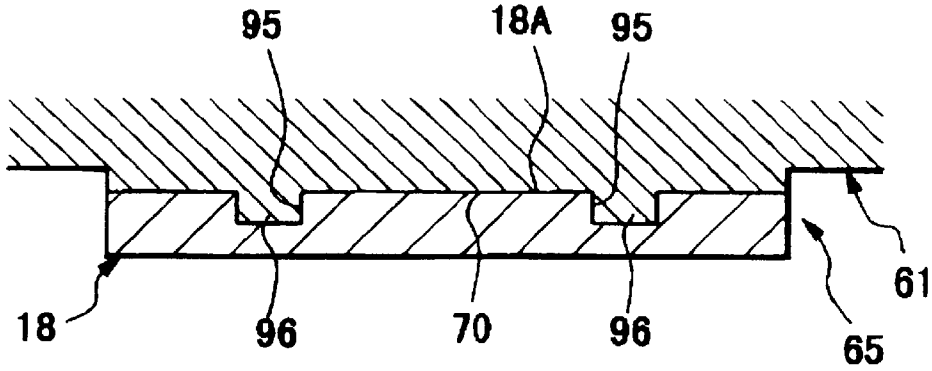
FIG. 22 is a fragmentary expanded sectional view showing mold projections of an upper mold that engage with bite sections of the cut sections of the permanent magnet shown in FIG. 21.
Figure 23:
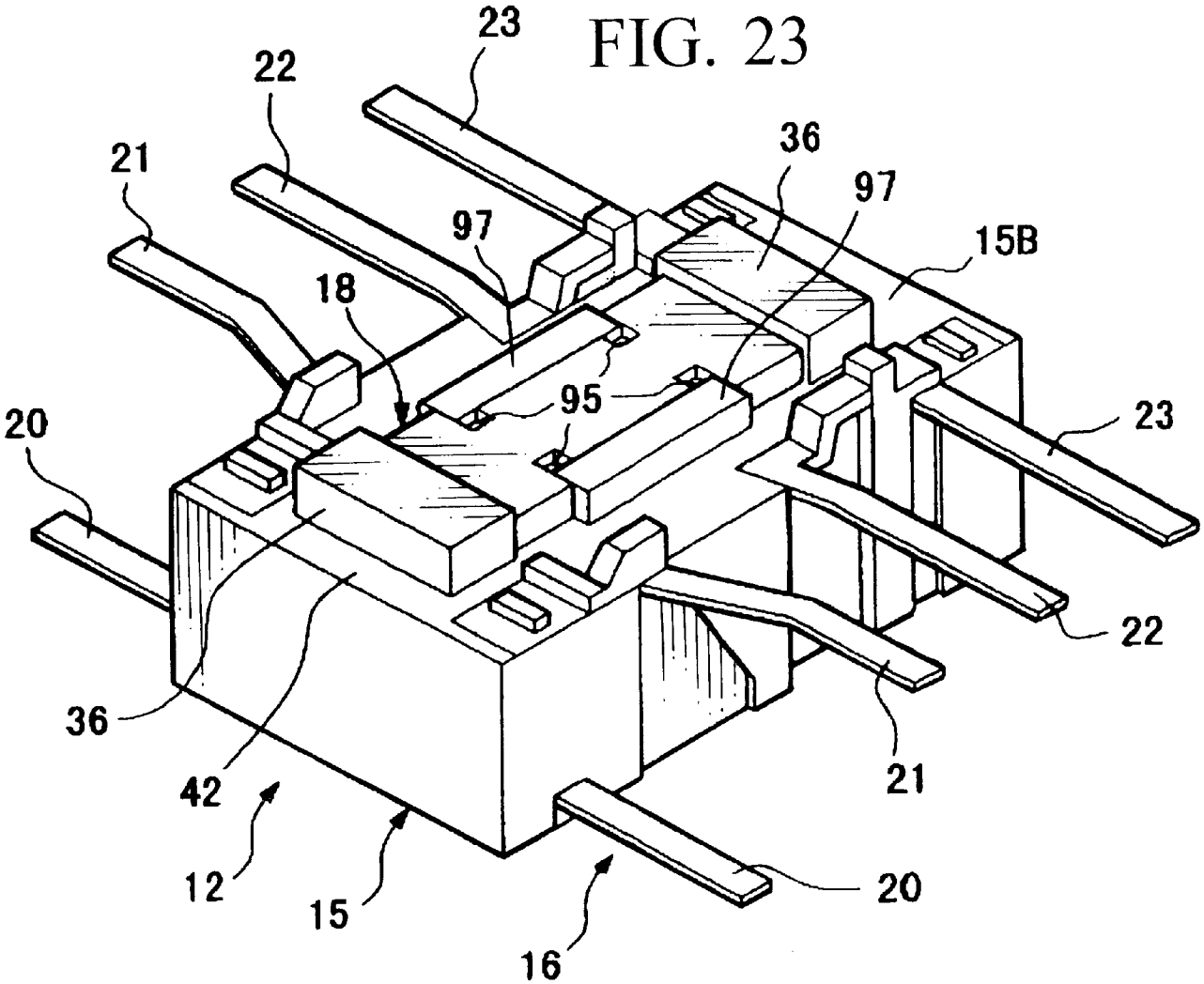
FIG. 23 is a perspective view showing a construction of an insulation base which is manufactured in accordance with the second modified example.

Next, a second modified example will be described with reference to FIGS. 21 to 23. As shown in FIG. 21, a pair of cut sections 93 are formed along both of elongated sides of the upper surface 18A of the permanent magnet 18, wherein they are arranged opposite to each other in the width direction of the permanent magnet 18. Each of the cut sections 93 consists of an intermediate section 94 that is elongated along the elongated side of the permanent magnet 18 and a pair of bite sections 95. Herein, the pair of the bite sections 95 are formed to extend from both ends of the intermediate section 94 in the width direction of the permanent magnet 18.

In addition, two pairs of mold projections 96 each having a square prism shape are formed on both sides of the second bottom wall 70 of the engagement channel 65 of the upper mold 61 in its width direction. Herein, one pair of mold projections 96 are arranged apart from another pair of mold projections 96 in a length direction of the second bottom wall 70. FIG. 22 shows only a pair of the mold projections 96, which are arranged apart from each other in the length direction of the second bottom wall 70. When the permanent magnet 18 is engaged with the engagement channel 65 of the upper mold 61, the two pairs of the mold projection 96, namely four mold projections 96, are respectively engaged with two pairs of the bite sections 95, namely four bite sections 95, within the cut sections 93. Herein, each pair of the mold projections 96 are arranged apart from each other by a certain interval of distance to match with each pair of the bite sections 95 so that positioning of the permanent magnet 18 is made in its elongated-side direction.

Under a condition where the permanent magnet 18 is set inside of the engagement channel 65 of the upper mold 61, the manufacturing device 56 operates the clamping device 58 to execute a clamping step for clamping the metal mold 57. Then, a material introduction step is executed to introduce the melted material of the fixed-side insulator 15 into the cavity of the metal mold 57 by the injection device 59. At this time, the melted material is introduced into both of the intermediate sections 94 of the cut sections 93 of the permanent magnet 18. As a result, a pair of engagement portions 97 are formed integrally from the contact fixing portion 42 of the fixed-side insulator 15. As shown in FIG. 23, the engagement portions 97 are formed to project upwardly along the elongated sides of the permanent magnet 18 on the upper surface 15B of the fixed-side insulator 15. Herein, tip portions of the engagement portions 97 are bent horizontally along a plane of the upper surface 15B so that the engagement portions 97 firmly engage with the intermediate sections 94 of the cut sections 93 of the permanent magnet 18.

In the above, a pair of the cut sections 93 are formed to partly cut side sections of the upper surface 18B of the permanent magnet 18 in connection with the armature block 13. In addition, the mold projections 96 engaging with the bite sections 95 of the cut sections 93 of the permanent magnet 18 are formed at prescribed positions of the engagement channel 65 of the upper mold 61 of the metal mold 57. Using the cut sections 93 and mold projections 96 which are engaged with each other, it is possible to realize positioning of the permanent magnet 18 in the metal mold 57. Therefore, in the clamping step, it is possible to accurately insert and engage the permanent magnet 18 between the side-end portions 36 of the U-shape iron core 31.

By letting the melted material of the fixed-side insulator 15 to flow into the intermediate sections 94 of the cut sections 93 of the permanent magnet 18, it is possible to form the engagement portions 97 from the contact fixing portion 92, wherein the engagement portions 97 have prescribed shapes that engage with the intermediate sections 94. Therefore, by using the cut sections 93 which are used for positioning of the permanent magnet 18, it is possible to provide a superior structure in which the engagement portions 97 of the contact fixing portion 92 engage with the cut sections 93 of the permanent magnet 18 in connection with the armature block 13 so that the permanent magnet 18 is certainly fixed to the U-shape iron core 31 of the coil block 17 with ease.

3. THIRD MODIFIED EXAMPLE

Figure 24:
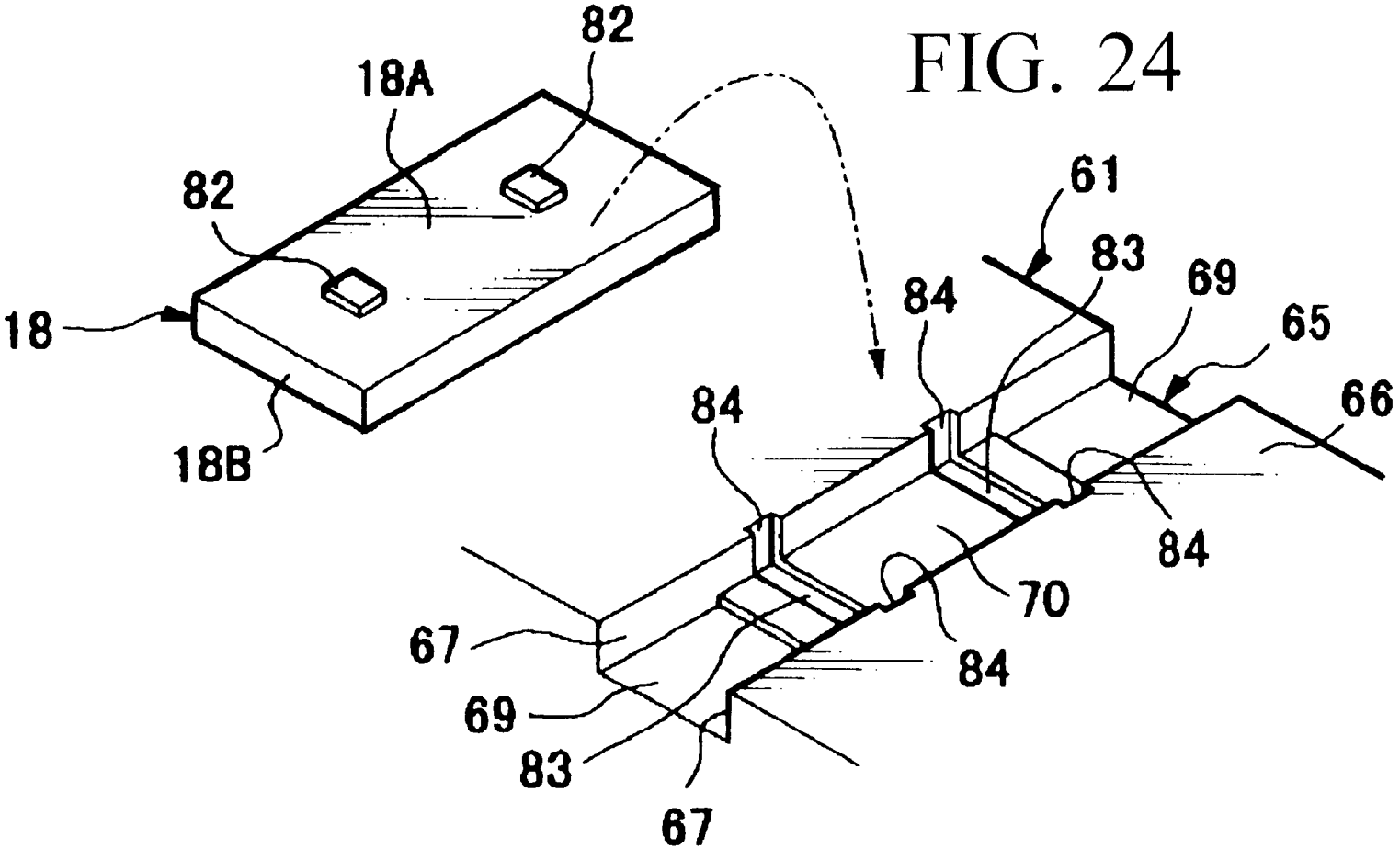
FIG. 24 is a perspective view showing a permanent magnet and selected parts of an upper mold, which are engaged with each other in accordance with a third modified example.
Figure 25:
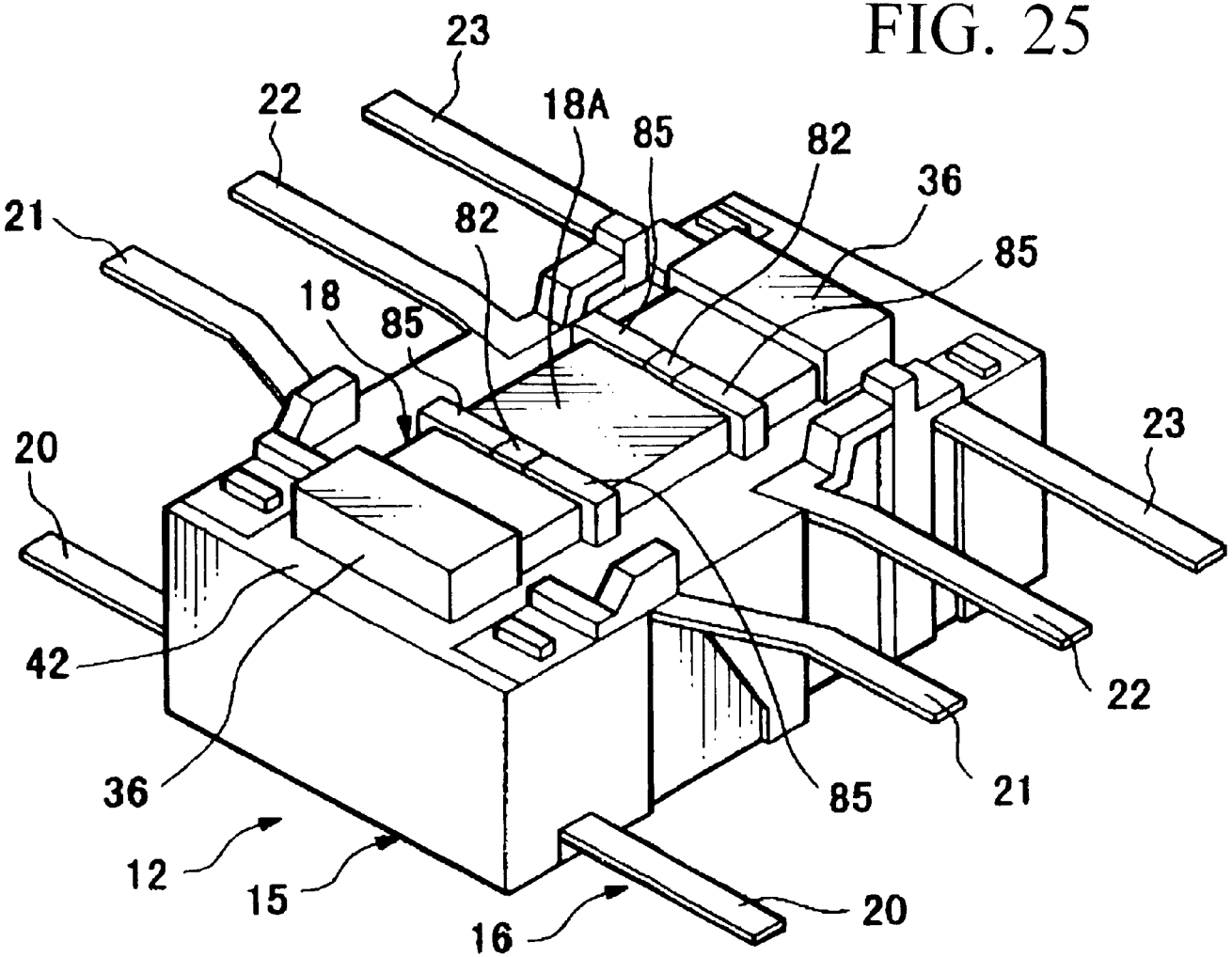
FIG. 25 is a perspective view showing an insulation base which is manufactured in accordance with the third modified example.

Next, a third modified example will be described with reference to FIGS. 24 and 25.

The foregoing examples and embodiment are designed such that concave portions such as the channels (41) are formed on the permanent magnet 18, while convex portions such as the mold projections (71) are formed on the upper mold 61. The third modified example is reversed in design as compared with the foregoing examples and embodiment. That is, as shown in FIG. 24, a pair of positioning projections 82 are formed to project from the upper surface 18A of the permanent magnet 18 in connection with the armature block 13. Herein, the positioning projections 82 are formed to align in a center portion of the upper surface 18A and are arranged apart from each other by a certain interval of distance in the elongated-side direction of the permanent magnet 18.

In addition, a pair of mold channels 83 are formed on the second bottom wall 70 of the engagement channel 65 of the upper mold 61 that holds the permanent magnet 18. Herein, the mold channels 83 are elongated in a width direction of the engagement channel 65 and are arranged apart from each other by a certain interval of distance in the elongated-side direction of the engagement channel 65. When the permanent magnet 18 is set inside of the engagement channel 65 of the upper mold 61, a pair of the positioning projections 82 of the permanent magnet 18 partly engage with a pair of the mold channels 83 of the engagement channel 65. The mold channels 83 are arranged apart from each other by the prescribed interval of distance to realize positioning of the permanent magnet 18 in its elongated-side direction. Incidentally, the positioning projections 82 partly occupy center portions of the mold channels 83, each of which is set in the width direction of the engagement channel 65.

Channels 84 are formed along the side interior walls 67 of the engagement channel 65 to extend vertically from ends of the mold channels 83, wherein they are formed perpendicular to a plane of the second bottom wall 70. That is, two channels 84 are extended vertically from both ends of the mold channel 83. When the melted material of the fixed-side insulator 15 is introduced into the metal mold 57, the mold channels 83 and channels 84 act as communications to introduce the melted material toward the positioning projections 82 of the permanent magnet 18. In addition, they contribute to formation of engagement portions 85, which are being interconnected with the positioning projections 82 of the permanent magnet 18 as shown in FIG. 25.

Under a condition where the permanent magnet 18 is set inside of the engagement channel 65, the manufacturing device 56 operates the clamping device 58 to execute a clamping step for clamping the metal mold 57. Then, a material introduction step is executed to introduce the melted material of the fixed-side insulator 15 into the cavity of the metal mold 57 by the injection device 59. At this time, the melted material is introduced into the mold channels 83 from the channels 84 in the engagement channel 65. As a result, engagement portions 85 are formed integrally from the contact fixing Portion 42 of the fixed-side insulator 15 as shown in FIG. 25. Herein, the engagement Portions 85 are formed to project upwardly from the upper surface 15B of the fixed-side insulator 15 along the elongated sides of the permanent magnet 18. In addition, end portions of the engagement portions 85 are bent horizontally along a plane of the upper surface 15B in the width direction of the permanent magnet 18. Thus, it is possible to integrally form the engagement portions 85, which are being interconnected with the positioning projections 82 of the permanent magnet 18 respectively.

In the above, the positioning projections 82 are formed on the upper surface 18A of the permanent magnet 18 in connection with the armature block 13, while molding channels 83 engaging with the positioning projections 82 are formed inside of the engagement channel 65 of the upper mold 61 of the metal mold 57. Using the positioning projections 82 and mold channels 83 which are engaged with each other, it is possible to set positioning of the permanent magnet 18 in the metal mold 57. Thus, it is possible to accurately insert and engage the permanent magnet 18 between the side-end portions 36 of the U-shape iron core 31 in the clamping step.

By letting the melted material of the fixed-side insulator 15 to flow into the mold channels 83 of the upper mold 61 of the metal mold 57, it is possible to form the engagement portions 85 from the contact fixing portion 42, wherein the engagement portions 85 have prescribed shapes being interconnected with the positioning projections 82 of the permanent magnet 18. Therefore, using the mold channels 83 of the metal mold 57 that are used to realize positioning of the permanent magnet 18, it is possible to provide a superior structure in which the contact fixing portion 42 partly engages with the permanent magnet 18 in connection with the armature block 13 so that the permanent magnet 18 is certainly fixed to the U-shape iron core of the coil block 17 in the insulation base 12.

Lastly, this invention has a variety of technical features and effects, which are summarized as follows:

(1) According to the electromagnetic relay of this invention, the contact fixing portion is formed integrally with the fixed-side insulator by its integral molding to fix the permanent magnet to the U-shape iron core while maintaining a contact condition where the permanent magnet is placed between and in contact with the side-end portions of the U-shape iron core. This eliminates necessity to perform welding or adhesion using the adhesive. In addition, it is possible to prevent the side-end portions from melting out due to sputters in welding, and it is possible to eliminate a wait time, which is conventionally needed for hardening of the adhesive. Therefore, it is possible to maintain the side-end portions in good shapes, by which good contact is established with respect to the armature of the armature block. Further, it is possible to reduce magnetic resistance between the U-shape iron core and armature. So, it is possible to improve yield in manufacturing the electromagnetic relays, and it is possible to improve productivity in producing the products by eliminating the unwanted wait time.

(2) The fixed-side terminal set and U-shape iron core are fixed to the fixed-side insulator by its integral molding. Due to the integral molding of the fixed-side insulator, the permanent magnet is fixedly attached to the U-shape iron core. The conventional technique teaches complicated steps in manufacture of the electromagnetic relay, in which a joint unit is made by jointing the U-shape iron core and permanent magnet together in advance, then, such a joint unit and a fixed-side terminal set are fixed to the fixed-side insulator by its integral molding. As compared with the conventional technique, this invention is capable of simplifying steps in manufacture of the electromagnetic relay, so it is possible to improve the productivity.

(3) The fixed-side terminal set, U-shape iron core and permanent magnet are all fixed to the fixed-side insulator by its integral molding. Herein, the permanent magnet is fixed to the U-shape iron core by the integral molding of the fixed-side insulator. Because of fixture of them at prescribed positions, it is possible to improve an accuracy in positioning of the fixed-side terminal set, U-shape iron core and permanent magnet.

(4) Channels are formed on the permanent magnet in connection with the armature block, while mold projections engaging with the channels are formed on the engagement channel of the upper mold of the metal mold. Using the channels and mold projections which engage with each other when the permanent magnet is set inside of the engagement channel of the upper mold, it is possible to realize positioning of the permanent magnet in the metal mold. Therefore, it is possible to accurately insert and engage the permanent magnet between the side-end portions of the U-shape iron core.

(5) The contact fixing portion is partly extended to form engagement portions that partly engage with the channels of the permanent magnet. In the integral molding of the fixed-side insulator, those engagement portions are formed with ease by introducing melted material of the fixed-side insulator into the channels of the permanent magnet. Using the channels which are used to set positioning of the permanent magnet in the metal mold, it is possible to provide a superior structure in which the contact fixing portion is partly engaged with the permanent magnet in connection with the armature block so that the permanent magnet is certainly fixed to the U-shape iron core of the coil block in the insulation base.

(6) The permanent magnet is modified such that positioning projections are formed on the upper surface of the permanent magnet in connection with the armature block. Using the positioning projections, it is possible to realize positioning of the permanent magnet. Therefore, it is possible to accurately insert and engage the permanent magnet between the side-end portions of the U-shape iron core.

(7) The contact fixing portion is partly extended to form engagement portions that are elongated to interconnect with the positioning projections of the permanent magnet. In the integral molding of the fixed-side insulator, those engagement portions are formed with ease by introducing the melted material of the fixed-side insulator into mold channels of the upper mold of the metal mold that partly engage with the positioning projections of the permanent magnet. Therefore, using the mold channels of the upper mold that is used to set positioning of the permanent magnet inside of the metal mold, it is possible to provide a superior structure in which the contact fixing portion is partly engaged with the permanent magnet in connection with the armature block so that the permanent magnet is certainly fixed to the U-shape iron core.

(8) A method for manufacturing the electromagnetic relay of this invention is characterized by an improved clamping step, which is effected after the permanent magnet is inserted and engaged between the side-end portions of the U-shape iron core. That is, the permanent magnet, U-shape iron core and fixed-side terminal set are fixed at prescribed positions in the metal mold under a contact condition where the side-end portions of the U-shape iron core are forced to be in contact with the terminal surfaces of the permanent magnet by pressing the exterior walls of the side-end portions with the sides molds of the metal mold. Then, a material introduction step is effected under a condition where a cavity corresponding to the shape of the fixed-side insulator is formed inside of the metal mold. That is, the melted material of the fixed-side insulator is introduced into the metal mold, so that all parts of the fixed-side insulator are being formed integrally. Thereafter, when hardening of the fixed-side insulator is completed, the contact fixing portion is automatically formed with the fixed-side insulator to fix the U-shape iron core and permanent magnet together at prescribed positions while maintaining the contact condition where the permanent magnet is forced to be in contact with the side-end portions of the U-shape iron core.

(9) As described above, the contact fixing portion is formed with the fixed-side insulator by its integral molding. That is, the permanent magnet is fixed to the U-shape iron core by the contact fixing portion in such a way that the permanent magnet is placed between and in contact with the side-end portions of the U-shape iron core, so it is unnecessary to perform adhesion using the adhesive. Therefore, it is possible to prevent the side-end portions from partially melting out by sputters in welding. In addition, it is possible to eliminate the wait time, which is needed for hardening of the adhesive. As a result, it is possible to maintain the side-end portions in good shapes. This provides good contact for the armature of the armature block. Thus, it is possible to reduce magnetic resistance between the U-shape iron core and armature, so it is possible to improve yield in producing electromagnet relays. Moreover, it is possible to improve productivity by eliminating the unwanted wait time.

(10) The melted material of the fixed-side insulator is introduced into the metal mold under a contact condition where the side-end portions of the U-shape iron core are brought into tight contact with the terminal surfaces of the permanent magnet by pressing the exterior walls of the side-end portions with the side molds that move to approach each other. This substantially eliminates spaces being formed between the side-end portions of the U-shape iron core and terminal surfaces of the permanent magnet. Therefore, it is possible to prevent insulating material from entering into the spaces, in other words, it is possible to prevent insulating layers from being formed in the spaces. Thus, it is possible to reduce magnetic resistance between the permanent magnet and U-shape iron core because of elimination of the spaces between them. So, it is possible to avoid reduction of the yield, which is conventionally caused due to increasing magnetic resistance between the permanent magnet and U-shape iron core by intervention of the spaces.

As this invention may be embodied in several forms without departing from the spirit of essential characteristics thereof, the present embodiment and its modified examples are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An electromagnetic relay comprising an insulation base and an armature block, said insulation base comprising:

a fixed-side terminal set including fixed contacts, a U-shape iron core whose middle portion is wound by a coil, a permanent magnet which is inserted and engaged between side-end portions of the U-shape iron core, and a fixed-side insulator which integrally holds the fixed-side terminal set, the U-shape iron core and the permanent magnet together, said armature block comprising:

a moving-side terminal set including moving contacts, an armature which is placed opposite to the side-end portions of the U-shape iron core, and a moving-side insulator which integrally holds the moving-side terminal set and the armature together, so that the armature block is supported by the insulation base to pivotally move on the permanent magnet, wherein the fixed-side terminal set, the U-shape iron core and the permanent magnet are fixed to the fixed-side insulator by its integral molding, wherein a contact fixing portion is formed with the fixed-side insulator, the contact fixing portion being integrally molded with the fixed-side insulator to fix the permanent magnet and the U-shape iron core together where the permanent magnet is placed in contact with the side-end portions of the U-shape iron core, and wherein channels are formed on an upper surface of the permanent magnet to face with the armature block, and the contact fixing portion is partly extended to form engagement portions that partly engage with the channels of the permanent magnet.

2. An electromagnetic relay comprising an insulation base and an armature block, said insulation base comprising:

a fixed-side terminal set including fixed contacts, a U-shape iron core whose middle portion is wound by a coil, a permanent magnet which is inserted and engaged between side-end portions of the U-shape iron core, and a fixed-side insulator which integrally holds the fixed-side terminal set, the U-shape iron core and the permanent magnet together, said armature block comprising:

a moving-side terminal set including moving contacts, an armature which is placed opposite to the side-end portions of the U-shape iron core, and a moving-side insulator which integrally holds the moving-side terminal set and the armature together, so that the armature block is supported by the insulation base to pivotally move on the permanent magnet, wherein the fixed-side terminal set, the U-shape iron core and the permanent magnet are fixed to the fixed-side insulator by its integral molding, wherein a contact fixing portion is formed with the fixed-side insulator, the contact fixing portion being integrally molded with the fixed-side insulator to fix the permanent magnet and the U-shape iron core together where the permanent magnet is placed in contact with the side-end portions of the U-shape iron core, and wherein positioning projections are formed on an upper surface of the permanent magnet to face with the armature block, and the contact fixing portion is partly extended to form engagement portions that interconnect with the positioning projections of the permanent magnet.

3. An electromagnetic relay comprising an insulation base and an armature block, said insulation base comprising a fixed-side insulator, a fixed-side terminal set including fixed contacts, a coil block in which a coil is wound about a middle portion of a U-shape iron core, and a permanent magnet which is inserted and engaged between side-end portions of the U-shape iron core, wherein the fixed-side insulator is made by molding using resin material to integrally hold the fixed-side terminal set, the coil block and the permanent magnet, the fixed-side terminal set, the coil block, and the permanent magnet being partially buried in the fixed-side insulator, and the fixed-side insulator is formed in a rectangular parallel-epiped shape having a contact fixing portion that partly extends to provide engagement portions engaging the permanent magnet by which the permanent magnet and the U-shape iron core are tightly fixed together under a contact condition where the permanent magnet is placed in tight contact with the side-end portions of the U-shape iron core, said armature block comprising a moving-side terminal set including moving contacts, an armature, and a moving-side insulator which integrally holds the moving-side terminal set and the armature together, wherein the armature block is mounted on the insulation base such that the moving contacts are respectively arranged to face the fixed contacts, and the armature block is supported by a support point formed projecting downwardly from a lower surface of said armature to pivotally move on the permanent magnet under an effect of electromagnetic force, and wherein channels are formed on an upper surface of the permanent magnet to face with the armature block, so that the engagement portions are formed in hook shapes that partly engage with the channels of the permanent magnet respectively.

4. An electromagnetic relay according to claim 3 wherein the contact condition is established by pressing exterior walls of the side-end portions of the U-shape iron core to be in tight contact with terminal surfaces of the permanent magnet, then, integral molding is effected to integrally form the fixed-side insulator having the contact fixing portion whose engagement portions firmly attach the permanent magnet between the side-end portions of the U-shape iron core without forming spaces therebetween.

5. An electromagnetic relay comprising an insulation base and an armature block, said insulation base comprising a fixed-side insulator, a fixed-side terminal set including fixed contacts, a coil block in which a coil is wound about a middle portion of a U-shape iron core, and a permanent magnet which is inserted and engaged between side-end portions of the U-shape iron core, wherein the fixed-side insulator is made by molding using resin material to integrally hold the fixed-side terminal set, the coil block and the permanent magnet, the fixed-side terminal set, the coil block, and the permanent magnet being partially buried in the fixed-side insulator, and the fixed-side insulator is formed in a rectangular parallel-epiped shape having a contact fixing portion that partly extends to provide engagement portions engaging the permanent magnet by which the permanent magnet and the U-shape iron core are tightly fixed together under a contact condition where the permanent magnet is placed in tight contact with the side-end portions of the U-shape iron core, said armature block comprising a moving-side terminal set including moving contacts, an armature, and a moving-side insulator which integrally holds the moving-side terminal set and the armature together, wherein the armature block is mounted on the insulation base such that the moving contacts are respectively arranged to face the fixed contacts, and the armature block is supported by a support point formed projecting downwardly from a lower surface of said armature to pivotally move on the permanent magnet under an effect of electromagnetic force, and wherein positioning holes are formed to penetrate through the permanent magnet, so that the engagement portions are formed in cylindrical shapes that engage with the positioning holes of the permanent magnet.

6. An electromagnetic relay comprising an insulation base and an armature block, said insulation base comprising a fixed-side insulator, a fixed-side terminal set including fixed contacts, a coil block in which a coil is wound about a middle portion of a U-shape iron core, and a permanent magnet which is inserted and engaged between side-end portions of the U-shape iron core, wherein the fixed-side insulator is made by molding using resin material to integrally hold the fixed-side terminal set, the coil block and the permanent magnet, the fixed-side terminal set, the coil block, and the permanent magnet being partially buried in the fixed-side insulator, and the fixed-side insulator is formed in a rectangular parallel-epiped shape having a contact fixing portion that partly extends to provide engagement portions engaging the permanent magnet by which the permanent magnet and the U-shape iron core are tightly fixed together under a contact condition where the permanent magnet is placed in tight contact with the side-end portions of the U-shape iron core, said armature block comprising a moving-side terminal set including moving contacts, an armature, and a moving-side insulator which integrally holds the moving-side terminal set and the armature together, wherein the armature block is mounted on the insulation base such that the moving contacts are respectively arranged to face the fixed contacts, and the armature block is supported by a support point formed projecting downwardly from a lower surface of said armature to pivotally move on the permanent magnet under an effect of electromagnetic force, and wherein cut sections are formed on elongated sides of the permanent magnet, so that the engagement portions are formed in elongated block shapes that engage with the cut sections of the permanent magnet respectively.

7. An electromagnetic relay comprising an insulation base and an armature block, said insulation base comprising a fixed-side insulator, a fixed-side terminal set including fixed contacts, a coil block in which a coil is wound about a middle portion of a U-shape iron core, and a permanent magnet which is inserted and engaged between side-end portions of the U-shape iron core, wherein the fixed-side insulator is made by molding using resin material to integrally hold the fixed-side terminal set, the coil block and the permanent magnet, the fixed-side terminal set, the coil block, and the permanent magnet being partially buried in the fixed-side insulator, and the fixed-side insulator is formed in a rectangular parallel-epiped shape having a contact fixing portion that partly extends to provide engagement portions engaging the permanent magnet by which the permanent magnet and the U-shape iron core are tightly fixed together under a contact condition where the permanent magnet is placed in tight contact with the side-end portions of the U-shape iron core, said armature block comprising a moving-side terminal set including moving contacts, an armature, and a moving-side insulator which integrally holds the moving-side terminal set and the armature together, wherein the armature block is mounted on the insulation base such that the moving contacts are respectively arranged to face the fixed contacts, and the armature block is supported by a support point formed projecting downwardly from a lower surface of said armature to pivotally move on the permanent magnet under an effect of electromagnetic force, and wherein positioning projections are formed on an upper surface of the permanent magnet, so that the engagement portions are formed in shapes that interconnect with the positioning projections of the permanent magnet respectively.

8. An electromagnetic relay according to claim 5 wherein the contact condition is established by pressing exterior walls of the side-end portions of the U-shape iron core to be in tight contact with terminal surfaces of the permanent magnet, then, integral molding is effected to integrally form the fixed-side insulator having the contact fixing portion whose engagement portions firmly attach the permanent magnet between the side-end portions of the U-shape iron core without forming spaces therebetween.

9. An electromagnetic relay according to claim 6 wherein the contact condition is established by pressing exterior walls of the side-end portions of the U-shape iron core to be in tight contact with terminal surfaces of the permanent magnet, then, integral molding is effected to integrally form the fixed-side insulator having the contact fixing portion whose engagement portions firmly attach the permanent magnet between the side-end portions of the U-shape iron core without forming spaces therebetween.

10. An electromagnetic relay according to claim 7 wherein the contact condition is established by pressing exterior walls of the side-end portions of the U-shape iron core to be in tight contact with terminal surfaces of the permanent magnet, then, integral molding is effected to integrally form the fixed-side insulator having the contact fixing portion whose engagement portions firmly attach the permanent magnet between the side-end portions of the U-shape iron core without forming spaces therebetween.

* * * * *